US006104822A

United States Patent [19]

Melanson et al.

[11] Patent Number: 6,104,822

[45] Date of Patent: Aug. 15, 2000

[54] DIGITAL SIGNAL PROCESSING HEARING AID

[75] Inventors: John L. Melanson; Eric Lindemann, both of Boulder, Colo.

[73] Assignee: AudioLogic, Inc., Boulder, Colo.

[21] Appl. No.: 08/907,337

[22] Filed: Aug. 6, 1997

Related U.S. Application Data

[63] Continuation of application No. 08/540,534, Oct. 10, 1995.

[51] Int. Cl.[7] ..... H04R 25/00

[52] U.S. Cl. ..... 381/320; 381/312

[58] Field of Search ..... 381/320, 321, 381/316, 317, 312, 314, 58, 98, 104, 106, 107, 109, 66

[56] References Cited

U.S. PATENT DOCUMENTS

| | | | |
|---|---|---|---|
| 3,622,714 | 11/1971 | Berkley et al. | 381/66 |
| 4,025,723 | 5/1977 | Blackledge . | |
| 4,232,192 | 11/1980 | Beex . | |
| 4,425,481 | 1/1984 | Mansgold et al. . | |
| 4,471,171 | 9/1984 | Kopke et al. . | |
| 4,628,529 | 12/1986 | Borth et al. . | |
| 4,718,099 | 1/1988 | Hotvet | 381/68.4 |
| 4,790,018 | 12/1988 | Preves et al. . | |
| 4,852,175 | 7/1989 | Kates . | |
| 4,972,487 | 11/1990 | Mangold et al. . | |
| 5,027,410 | 6/1991 | Williamson et al. | 381/320 |
| 5,029,217 | 7/1991 | Chabries et al. . | |
| 5,233,665 | 8/1993 | Vaughn et al. . | |
| 5,259,033 | 11/1993 | Goodings et al. . | |
| 5,303,306 | 4/1994 | Brillhart et al. . | |
| 5,394,475 | 2/1995 | Ribic . | |
| 5,406,635 | 4/1995 | Jarvinen . | |
| 5,412,735 | 5/1995 | Engebretson et al. . | |
| 5,488,668 | 1/1996 | Waldhauer . | |
| 5,500,902 | 3/1996 | Stockham, Jr. et al. . | |
| 5,528,696 | 6/1996 | Ribic . | |

FOREIGN PATENT DOCUMENTS

| | | | |
|---|---|---|---|
| 0 326 905 A1 | 1/1989 | European Pat. Off. | H04R 25/00 |
| 0 446 037 A2 | 3/1991 | European Pat. Off. | H04B 1/66 |

OTHER PUBLICATIONS

Widin, Gregory P., "The Meaning of Digital Technology", Hearing Instruments, vol. 38, No. 11, Nov. 1987.

Leickel, Torsten, et al., "Efficient Digital–Signal–Processor Realization of Multiple Filter Banks Using Wave Digital Filters", IEEE, vol. 5, p. 2316–2319, May 10, 1992.

Black, N.D., et al., "Programmable Audiogram Matching Using a Frequency Sampling Filter Implemented on the Texas TMS", IEEE, vol. 2, p. 225–228, Mar. 23, 1992.

Engebretson, A.M., "Benefits of Digital Hearing Aids", IEEE Engineering in Medicine and Biology Magazine, vol. 13, No. 2, p. 238–248, Apr. 1, 1994.

Ventura, J. C., "Digital Audio Gain Control for Hearing Aids", IEEE, vol. 3, p. 2049–2052, May 23, 1989.

Steeger, G. H., "Ein tragbares Signalprozessor–System zur Evaluierung digitaler Horgerate–Algorithmen", Audiologische, p. 126–132, Akustik 3, 1995, (English summary appears at p. 127).

(List continued on next page.)

*Primary Examiner*—Vivian Chang
*Attorney, Agent, or Firm*—Fenwick & West LLP

[57] ABSTRACT

A digital signal processing hearing aid is disclosed having a plurality of digital signal processing means for processing input digital signals, and a selector switch manipulable by a user for choosing which of the processing means to utilize. Each of the digital signal processing means is designed to provide optimal results in a particular listening environment. Since the user is allowed to choose which of the plurality of processing means to invoke, and since each processing means is specifically designed to operate in a particular listening environment, the hearing aid is capable of providing excellent results in a plurality of listening environments.

5 Claims, 22 Drawing Sheets

OTHER PUBLICATIONS

Douglas M. Chabries, et al., "Application of Adaptive Digital Signal Processing to Speech Enhancement for the Hearing Impaired," *Journal of Rehabilitation Research and Development*, vol. 24, No. 4, pp. 65–74.

Brian R. Glasberg et al., "Auditory Filter Shapes In Subjects With Unilateral and Bilateral Cochlear Impairments," *Journal, Acoustical Society of America*, vol. 79, No. 4, Apr. 1986, pp. 1020–1033.

Mead C. Killion, "Short Course: The K–Amp Hearing Aid: An Attempt to Present High Fidelity for Persons with Impaired Hearing," *American Speech–Language–Hearing Association*, Jul. 1993, pp. 52–74.

B. Kollmeier, "Speech Enhancement by Filtering in the Loudness Domain," *Acta Otolaryngol* (*Stockholm*), Suppl. 469, 1990, pp. 207–214.

R. P. Lippmann, et al. "Study of Multichannel Amplitude Compression and Linear Amplification for Persons With Sensorineural Hearing Loss," *Journal, Acoustical Society of America*, vol. 69, No. 2, Feb. 1981, pp. 524–534.

Brian C. J. Moore, et al., "Optimization of a Slow–Acting Automatic Gain Control System for Use in Hearing Aids," *British Journal of Audiology*, vol. 25, 1991, pp. 171–182.

Gregory Russell Martin, "Studies of Real–Time Multiband Adaptive Gain Hearing Aids," *Department of Electrical Engineering and Computer Science*, Massachusetts Institute of Technology, Sep. 1992, pp. 1–72, Appendices A, B, and C.

Brian C. J. Moore, "How Much Do We Gain by Gain Control in Hearing Aids?," *Acta Otolaryngol* (*Stockholm*), Suppl. 469, 1990, pp. 250–256.

Brian C. J. Moore, et al., "Evaluation of a Dual–Channel Full Dynamic Range Compression System for People With Sensorineural Hearing Loss," *Ear and Hearing*, vol. 13, No. 5, 1992, pp. 349–370.

Igor V. Nábelek, "Performance of Hearing–Impaired Listeners Under Various Types of Amplitude Compression," *Journal, Acoustical Society of America*, vol. 74, No. 3, Sep. 1983, pp. 776–791.

Reinier Plomp, "The Negative Effect of Amplitude Compression in Multichannel Hearing Aids in the Light of the Modulation—Transfer Function," *Journal, Acoustical Society of America*, vol. 83, No. 6, Jun. 1988, pp. 2322–2327.

Edgar Villchur, "Comments on The Negative Effect of Amplitude Compression in Multichannel Hearing Aids in the Light of Modulation–Transfer Function," *Journal Acoustical Soceity of America*, vol. 86, No. 1, Jul. 1989, pp. 425–427.

Fred Waldhauer et al., "Full Dynamic Range Multiband Compression in a Hearing Aid," *The Hearing Journal*, Sep. 1988, pp. 1–4.

Gary Walker, et al., "The Effects of Multichannel Compression/Expansion Amplification on the Intelligibility of Nonsense Syllables in Noise," *Journal, Acoustical Society of America*, vol. 76, No. 3, Sep. 1984, pp. 746–757.

Paul Yanick, Jr., "Effects of Signal Processing on Intelligibility of Speech in Noise for Persons With Sensorineural Hearing Loss," *Journal of The American Audiology Society*, vol. 1, No. 5, The Williams & Wilkins Co., 1976, pp. 229–238.

DIGITAL SIGNAL PROCESSING HEARING AID

This is a continuation Ser. No. 08/540,534 filed on Oct. 10, 1995.

BACKGROUND OF THE INVENTION

A common problem associated with sensorineural hearing loss is recruitment. A hearing impaired person suffering from recruitment has an elevated threshold for soft sounds. This means that soft sounds which are audible to a person with normal hearing will have to be made louder in order to be heard by the hearing impaired person. However, with recruitment, loud sounds may be just as loud for the hearing impaired person as for the person with normal hearing. This represents a loss of dynamic range for the hearing impaired. This loss of dynamic range may vary with frequency. For example, at low frequencies the hearing impaired person may have nearly the same dynamic range as the person with normal hearing, but at high frequencies the dynamic range of the hearing impaired person may be considerably reduced. This impaired dynamic range is often referred to as the residual dynamic range.

The loss of dynamic range in the hearing impaired is most often attributed to malfunction of the outer hair cells of the cochlea. Sound vibrations in the air are transmitted from the ear drum and through the ossicles of the middle ear to the inner ear and the cochlea. Inside the cochlea are the flexible tectorial membrane and the more rigid basilar membrane. Between these two membranes lie the inner and outer hair cells. Ninety-five percent of the afferent neural fibers which transmit acoustic information to the brain are connected to the inner hair cells. The longest cilia of the outer hair cells are connected to the tectorial membrane, but the inner hair cells have no such connection. Both the inner and outer hair cells are connected to the basilar membrane through supporting cells. Vibrations passing between the tectorial and basilar membranes cause more motion in the flexible tectorial membrane than in the basilar membrane. This difference in motion causes a sheering motion along the outer hair cells. The outer hair cells react to this shearing motion in a complex manner. The entire mechanism is not yet clearly understood but it appears that the outer hair cells stretch and contract according to the intensity of the vibrations in a manner which amplifies these vibrations. For larger amplitude vibrations, however, the outer hair cell motion saturates causing a reduction in amplification. This nonlinear, saturating amplification corresponds to a natural dynamic range compression. The compressed vibrations from the outer hair cells are communicated to the inner hair cells and then through the afferant neural fibers to the brain. When the outer hair cells malfunction, there is a loss of natural compression and recruitment occurs. The inner hair cells may continue to functions normally and there may be a mild to moderate hearing loss. More severe hearing losses will occur with loss of inner hair cell function.

Many hearing aid instruments have been designed to deal with this problem. The approach taken is to compress the dynamic range of the input sound signal so that it more nearly fits into the residual dynamic range of the recruited ear. The ratio of input dynamic range in dB to compressor output dynamic range in dB is called the compression ratio. To adequately specify the compressor, the compression ratio needs to be accompanied by a static gain value. This static gain value will determine at which input power level the system delivers a specified fixed gain. For example the static gain may be set so that at 80 dB SPL input power, the system delivers unity gain. If the compressor is set to a 2:1 compression ratio, then at 60 dB SPL input power the system will produce a 70 dB SPL output, that is a gain of 10 dB, and at 100 dB SPL input power the system will produce a 90 dB SPL output, that is a gain of −10 dB.

Usually the compression ratio is not constant over the entire input power range. A low level compression knee may be defined. For input powers below this low level compression knee, the compression ratio may be 1:1, that is, a fixed linear gain may be applied. The designated compression ratio (e.g. 2:1) may take affect only for input power levels above this low level compression knee. A high level or limiting knee may also be defined. For input power levels above this high level knee, the compression ratio may increase or even become infinite, or it may be that the output level is fixed regardless of increase in input level. A system which has only a high level compression knee below which the compression ratio is 1:1 (linear gain) is called a limiter. A system which has a low level compression knee positioned at 40–50 dB SPL is termed a full range compressor.

Even without reference to the electro-mechanics of the inner ear and the natural loss of compression due to malfunction of the outer hair cells, the need for compressors or limiters in hearing aids has long been recognized. The need for hearing aids to have large gains to make softer sounds audible has driven amplifiers and output transducers out of their linear ranges. Earlier hearing aids accomplished limiting by letting the amplifier and/or output transducer clip. Unfortunately this caused harmonic distortion which, at high frequencies, masked softer speech sounds and generally reduced fidelity in the system (See M. C. Killian, The K-Amp Hearing Aid: An Attempt to Present High Fidelity for Persons with Impaired Hearing, American Speech-Language-Hearing Association, July 1993, at 52–74). Later systems introduced limiters to help alleviate this problem, and still later systems used full range dynamic range compression (See e.g. Fred Waldhauer et al., Full Dynamic Range Multiband Compression in a Hearing Aid, The Hearing Journal, September 1988, at 1–4).

The compression process requires a means for measuring the power of the input signal and generating a dynamically varying gain as a function of this input power. This gain is then applied to the signal which is delivered to the ear. When the input power is low, this gain will generally be high so that soft sounds are made louder. When the input power is high, this gain will generally be low so that loud sounds are not made too loud. The measure of input power requires averaging over time. The time span of the averaging defines a compression time constant. If the time span is very long then the compressor will react slowly to changes in input power level. This is sometimes referred to as Automatic Gain Control (AGC) where time constants of one to two seconds are typical. When the time span of the averaging is short the compressor will react quickly to changes in input power level. With a time span of approximately five to fifty milliseconds, the compressor may be referred to as a syllabic rate compressor. A syllabic rate compressor will limit the gain of a loud vowel sound while amplifying a soft consonant which immediately follows it.

In most designs there is both an attack and release compressor time constant. The attack time constant determines the time it takes for the compressor to react at the onset of a loud sound. That is, the time it takes to turn down the gain. The release time constant determines the time it takes for the system to turn up the gain again after the loud sound has terminated. Most often the attack time is quite short (<5 milliseconds) with the release time being longer (anywhere from 15 to 100s of milliseconds).

Even with separate attack and release times, there have still been problems with compressor time constants. With a long release time, any short impulse in the room (e.g. the clank of a dish) will cause the gain to be shut down for the length of the relatively long release time. On the other hand, if the time constant is always short, it will cause an annoying swell in volume every time a speaker takes a breath. This problem has been alleviated by the introduction of adaptive time constants. Hotvet introduced in U.S. Pat. No. 4,718,499 an adaptive time constant system in which the release time constant for a loud sound in silence is short but the release time constant gradually becomes longer proportional to the length of the louder sounds in the environment. Thus, if a speaker speaks in a normal rhythm, the release time constant will grow longer, reducing the amplitude swell in the brief silences between words. Others have also discussed multiple time constant systems with a similar goal in mind (See e.g. R. F. Laurence, et al., A Comparison of Behind-the Ear High-Fidelity Linear Hearing Aids and Two-Channel Compression Aids, in the Laboratory and in Everyday Life, Br. J. Audiol., 1983, at 17:31–48; and Brian Moore, et al., Optimization of a Slow-Acting Automatic Gain Control System for Use in Hearing Aids, Br. J. Audiol., 1991, at 25:171–182).

To match the variability of recruitment with frequency, a compressor is often designed to perform differently in different frequency bands. A multi-band compressor divides the input signal into multiple frequency bands and then measures power in each band and compresses each band separately with possibly different compression ratios and time constants in the different bands. For example a properly designed two band compressor can make soft high frequency consonants audible while suppressing low frequency competing noises occurring simultaneously. Vilchur (See E. Vilchur, Signal Processing to Improve Speech Intelligibility in Perceptive Deafness, J. Acoust. Soc. Am. 53, 1973, at 1646–1657) discussed a bench top prototype of a two band compressor. Barfod (See J. Barfod, *Multichannel Compression Hearing Aids*, Report No. 11, The Acoustic Laboratory, Technical University of Denmark, 1976) discussed compressors of up to four bands. These compressors also had variable time constants in the different frequency bands.

The outer hair cells of the cochlea, when functioning normally, are often thought to perform compression function in overlapping frequency bands called critical bands. These frequency bands are spaced linearly at intervals of approximately 100 Hz at frequencies below about 500 Hz, and are spaced logarithmically at approximately third octave intervals above 500 Hz. Thus, the outer hair cells behave as a biological critical band compressor. The time constant associated with this compressor has been approximated to be about 1 ms. Lippman et. al. (See R. P. Lippman, et al., Study of Multichannel Amplitude Compression and Linear Amplification for Persons with Sensorineural Hearing Loss, J. Acoust. Soc. Am. 69(2), February 1981, at 524–534) designed a benchtop 16 band compressing hearing aid system with the bands tuned to match the critical bands of hearing. Each band represented a separate compression channel. Two settings of this compressor were compared against a linear non-compressing system. Martin (See G. R. Martin, *Studies of Real-Time Multiband Adaptive Gain Hearing Aids*, MIT, September 1992, at 1–103) discussed a 3$^{rd}$ octave band compression hearing aid system using digital signal processing.

As the number of compression bands increases, each with its own compression ratio and static gain, it is possible to view the compressor as having an almost continuously varying compression ratio as a function of frequency. In this case the system may, be represented as a set of frequency dependent gain curves. Each gain curve applies at a certain input power level. For input between these power levels, the system interpolates between gain curves. Killian (previously cited) discusses the K-amp hearing aid system which integrates power in one band but uses the power estimate to interpolate between low level and high level frequency response curves. The low power level frequency response curve has generally more gain and, in particular, more gain at high frequencies then at low. The high power level frequency response curve has generally less gain and is more flat across frequencies. There is an optional setting which allows the low power level curve to also be set flat.

The process of adjusting the compression ratios or gain curves of a compressor is central to the hearing aid fitting process. One approach to doing this is to attempt to adjust the compressor so that for all input levels and all frequencies the hearing impaired listener has the same impression of loudness that a normal listener would have. Loudness is a perceptual quantity which can under certain constraints be plotted as a function of input power level. The loudness growth curve may be measured by presenting a number of input signals at different levels and asking the listener to subjectively rate these on a perceptual scale (e.g. 1 to 10). By measuring the loudness growth curves of an impaired listener at different frequencies and comparing these to the loudness growth curves of an average of normal listeners, a loudness matching compression fitting can be attempted. To accurately match loudness growth curves, the hearing instrument would permit continuously variable compression ratio over input level. In this case it is more useful to think in terms of continuously variable input/output power curves. The system described above with low and high level compression knees is able to implement only three segment piecewise input output curves. Barfod (previously cited) and Lippman et. al. (previously cited) attempted to fit their multi-band compression systems so as to restore the loudness growth curves of the impaired ear to match those of the normal ear.

Loudness matching compression fitting has its limits. If the recruited ear has 5 dB of residual dynamic range it will not be effective to compress a 90 dB input dynamic range into this 5 dB. Instead, some amount of compression will be applied and then a static gain defined so that the most useful part of the input dynamic range (e.g. typical speech range) is roughly centered in the residual dynamic range. Limiting will be applied for louder signals. Finding good compromises in fitting compressors is central to the art of hearing aid fitting.

There has been some discussion about whether it is indeed necessary to test the loudness growth curves of the impaired listener as part of the fitting process or whether it is possible to predict them from the threshold audiograms. Kollmeier et al. (See B. Kollmeier, el al., Speech Enhancement by Filtering in the Loudness Domain, Acta Otolaryngol (Stockh) 1990, Suppl. 469:207–214) has shown that the shape of loudness growth curves becomes less predictable with increasing hearing loss. That is, the variance between subjects increases with hearing loss. This indicates that successful prediction from the threshold is unlikely.

There has been much discussion regarding the nature of improvements due to compression. Vilchur (previously cited) and Yanick (See P. Yanick, Effects of Signal Processing on the Intelligibility of Speech in Noise for Subjects Possessing Sensorineural Hearing Loss, J. Am. Audiol. Soc.

1, 1976, at 229–238) showed improvements in intelligibility with their compression systems, while Abramovits (See R. Abramovits, The Effects of Multichannel Compression Amplification and Frequency Shaping on Speech Intelligibility for Hearing Impaired Subjects, Unpublished doctoral thesis, City University of New York, 1979), Mangold et al. (See S. Mangold, et al., Programmable Hearing Aid with Multichannel Compression, Scand. Audiol. 8, 1979, at 121–126), O'Loughlin (See B. O'Loughlin, Evaluation of a Three Channel Compression Amplification System on Hearing-Impaired children, Aust. J. Audiol. 2, 1980, at 1–9), and Lippman et al. (previously cited) failed to show intelligibility improvements. It has also been argued in Moore (See Brian Moore, Evaluation of a Dual-Channel Full Dynamic Range Compression System for People with Sensorineural Hearing Loss, Ear and Hearing, Vol. 13, No. 5, 1992, at 349–370) that it is necessary to evaluate improvement by testing in the real world for sustained periods of time. Plomp (See Reinier Plomp, The Negative Effect of Amplitude Compression in Multichannel Hearing Aids in the Light of the Modulation-Transfer Function, J. Acoust. Soc. Am. 83(6), June 1988, at 2322–2327) has suggested that multi-band compression would be detrimental to speech intelligibility because the reduction in dynamic range does not imply a reduction in the size of the just noticeable difference (JND) in amplitude discrimination. Plomp has further suggested that fast time constant compression would lead to reduced amplitude modulation over time, which in turn, would lead to reduced perception of this modulation. It has also been suggested that very fast time constants can create harmonic distortion at low frequencies. The argument was also put forward that fast time constant multi-band compression would reduce spectral contrasts over frequency, thus "whitening" the spectrum, thereby lessening the ability to distinguish vowels. Vilchur (See E. Vilchur, Comments on the Negative Effect of Amplitude Compression in Multichannel Hearing Aids in the Light of the Modulation-Transfer Function, J. Acoust. Soc. Am. 86(1), July 1989, at 425–428) responded to these points. Others have written on related topics. See e.g. L. D. Braida, et al., Review of Recent Research on Multiband Amplitude Compression for the Hearing Impaired, The Vanderbilt Hearing Report, Upper Darby, Pa.: Monographs in Contemporary Audiology, 1982, at 133–140; B. R. Glasberg, et al., Auditory Filter Shapes in Subjects with Unilateral and Bilateral Cochlear Impairments, J. Acoust. Soc. Am. 79, 1986, at 1020–1033; Brian Moore, How Much Do We Gain by Gain Control in Hearing Aids?, Acta Otolaryngol, 1990, 469 Suppl. at 250–256; Igor Nabelek, Performance of Hearing-Impaired Listeners under Various Types of Amplitude Compression, J. Acoust. Soc. Am. 74(3), September 1983, at 776–791; and Walker et al., The Effects of Multichannel Compression/Expansion Amplification on the Intelligibility of Nonsense Syllables in Noise, J. Acoust. Soc. Am. 76(3), September 1984, at 746–757.

Most agree that some form of limiting is required so that loud sounds are not too loud but soft sounds are audible. The debate is focused on full range vs. limiting compression, and on fast vs. slow time constants. Moore (previously cited) suggests that a two or three band compressor, while having sufficient frequency resolution to allow attenuation of low frequency noise and vowel sounds, and while permitting amplification of softer high frequency consonants, is still coarse enough in frequency, as opposed to a critical band compressor, such that spectral whitening will not occur.

Given two input signals of equal energy, one narrow band so that its frequency range is entirely within one critical band, and another wide band so that its frequency range spans several critical bands, the wide band signal will appear louder to the listener. This is due to a psychoacoustic phenomenon called loudness summation. This has implications for compressor design. If the compressor has a few wide bands (e.g. 2), and if the compressor is adjusted such that wide band signals are well matched in loudness to normal loudness growth curves, then narrow band signals will appear too soft. Conversely if the compressor has many independent narrow bands (e.g. critical bands), and if the compressor is adjusted such that narrow band signals are well matched in loudness to normal loudness growth curves, then wide band signals will appear too loud. Hohman (See V. Hohman, Narrow/Wide Band Compensation in Coupled Narrow Band Aid, Reihe 17: Biotechnik, Nr. 93, 1993, at 1–99) has designed a compressor which addresses this problem. It measures not only power but bandwidth of input signals and adjusts gain accordingly. This is called a coupled narrow band compressor.

As illustrated by the above discussion, different signal processing strategies have been developed to address different and specific hearing aid problems. In an attempt to increase the versatility of hearing aids, adjustable hearing aids have been developed. With adjustable hearing aids (which typically employ analog signal processors), certain parameters can be adjusted by the user. By allowing the user to dynamically set the parameters, the adjustable hearing aid allows the user to set the hearing aid to best suit the user's listening environment. While an adjustable hearing aid does impart to the user a greater degree of versatility, this versatility has its limits. Ultimately, an adjustable hearing aid implements the same signal processing strategy, regardless of the parameters. If the particular strategy implemented by the hearing aid is not well-suited for a particular situation, then no amount of parameter adjustment will cause the hearing aid to provide satisfactory results.

SUMMARY OF THE INVENTION

The present invention is based, at least partially, on the observation that, given all of the available signal processing strategies and all of the possible listening environments that a user may find himself or herself in, there is no single signal processing strategy which provides optimal performance in all situations. In order to be optimal, a hearing aid needs to implement different signal processing strategies for different situations, with each strategy designed for a particular situation. The present invention provides just such a hearing aid.

In accordance with the present invention, there is provided a hearing aid comprising a an input transducer, an analog-to-digital converter, a plurality of digital signal processing means, a processing means selector manipulable by a user, a digital-to-analog converter, and an output transducer. Preferably, each of the digital signal processing means implements a particular processing strategy designed for a particular situation. The processing means selector allows the user to select which digital signal processing means to invoke so that the user may dynamically choose the best processing means, and hence, the best strategy for any particular listening environment. In a preferred embodiment, the plurality of digital signal processing means of the hearing aid of the present invention is implemented by way of a logic unit and a multi-program store for storing a plurality of instruction sequences. These instruction sequences, when executed by the logic unit, cause the logic unit to implement the functions of the various digital signal processing means. To change digital signal processing means, all that needs to be done is to have the logic unit execute a different set of instruction sequence. Hence, the present invention provides a hearing aid capable of: (1) implementing a number of different signal processing strategies; and (2) allowing a user to select which strategy is implemented, thereby allowing the user to choose the best strategy for any given situation. Overall, the present invention provides a functionally superior hearing aid.

DETAILED DESCRIPTION OF THE PREFERRED EMBODIMENTS

Figure 1A:
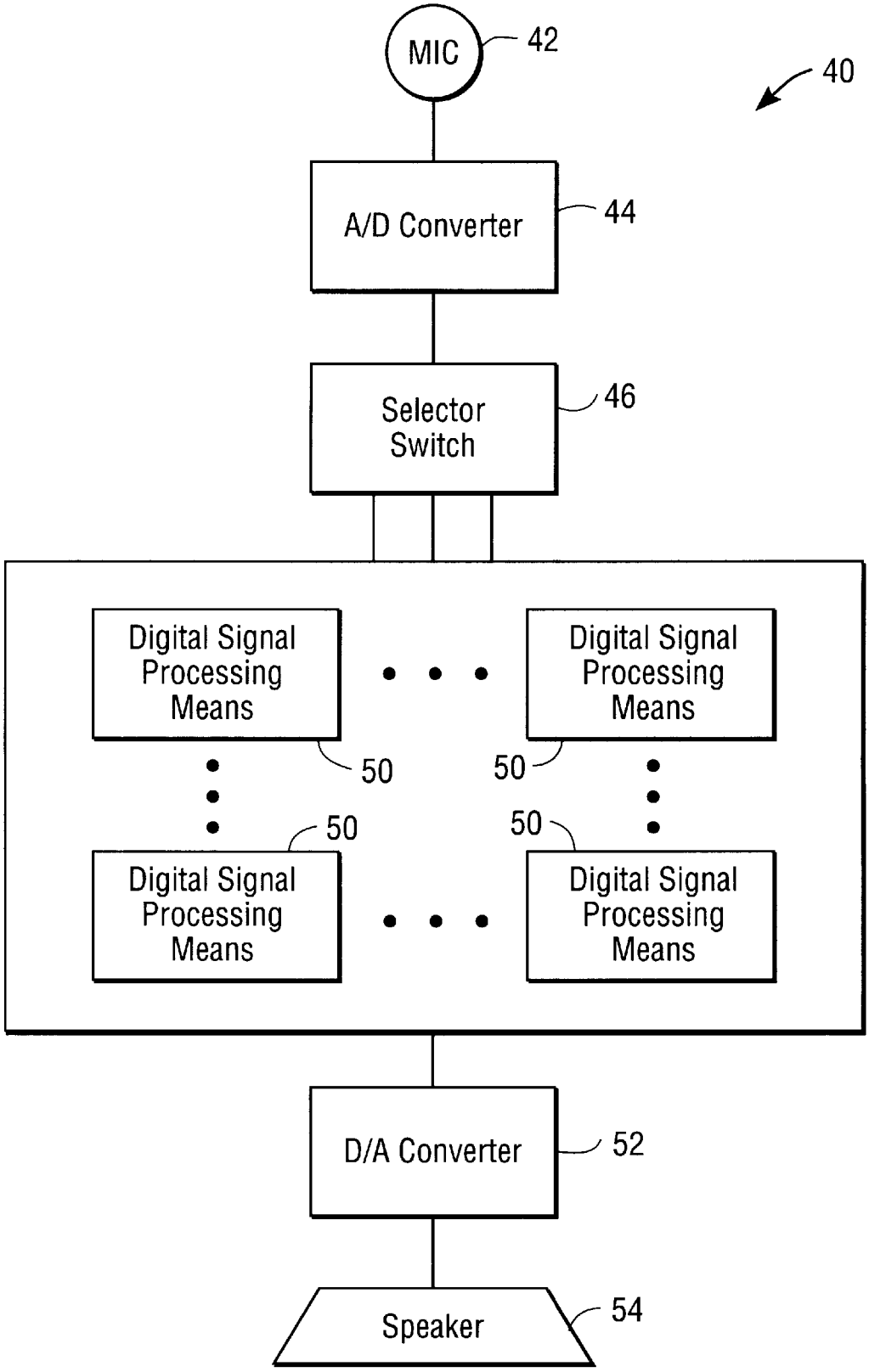
FIG. 1*a* is a block diagram representation of the hearing aid of the present invention.

With reference to FIG. 1*a*, there is shown a block diagram representation of the hearing aid of the present invention, the hearing aid 40 preferably comprising an input transducer 42 (preferably taking the form of a microphone), an analog-to-digital converter 44, a selector switch 46, a plurality of digital signal processing means 50, each selectable by selector switch 46, a digital-to-analog converter 52, and an output transducer 54 (preferably taking the form of a speaker). The selector switch 46 is preferably manipulable by a user to allow the user to dynamically select which of the digital signal processing means 50 to invoke in which listening environment. Preferably, each of the digital signal processing means 50 is specifically and optimally designed to deal with a particular listening environment. For example, one of the digital signal processing means 50 may be designed to compensate for noisy environments, while another may be tailored for quiet environments. In dealing with these environments, each of the processing means 50 may implement such functions as compression, noise compression, feedback cancellation, etc.

The hearing aid of FIG. 1*a* operates by receiving audio signals, via the microphone 42, from a particular listening environment, and converting these audio signals into a set of analog electrical signals. These electrical signals are then converted by the analog-to-digital converter 44 into an input digital signal or stream. The input digital stream is then fed to one of the digital signal processing means 50 selected by the selector switch 46, where the input digital stream is processed to derive an output digital signal or stream. This output digital stream is thereafter processed by the digital-to-analog converter 52 to derive a set of output analog electrical signals. Once derived, the analog electrical signals are used to drive the speaker 54 to cause the speaker to produce a set of audio signals which can be heard by the hearing aid user.

A significant advantage provided by the hearing aid of the present invention is that it is capable of implementing a plurality of different rehabilitation strategies. This is in sharp contrast to the adjustable hearing aids of the prior art which are capable of implementing only a single strategy with adjustable parameters. Because the hearing aid of the present invention can implement more than one strategy (i.e. can change from one strategy to another), it is better able to adapt and to provide optimal results in a variety of different listening environments. As used herein, the expression "changing strategies" means generally switching from one digital signal processing means 50 to another. In actuality, what is often changed in going from one processing means to another is the number of bandpass signals into which the input digital signal is divided, and the bandwidths of these bandpass signals. Thus, by changing strategies, the hearing aid of the present invention is in effect changing the specifications of the filter banks of the digital signal processing means 50. This will become more clear as the invention is described in greater detail.

Figure 1B:
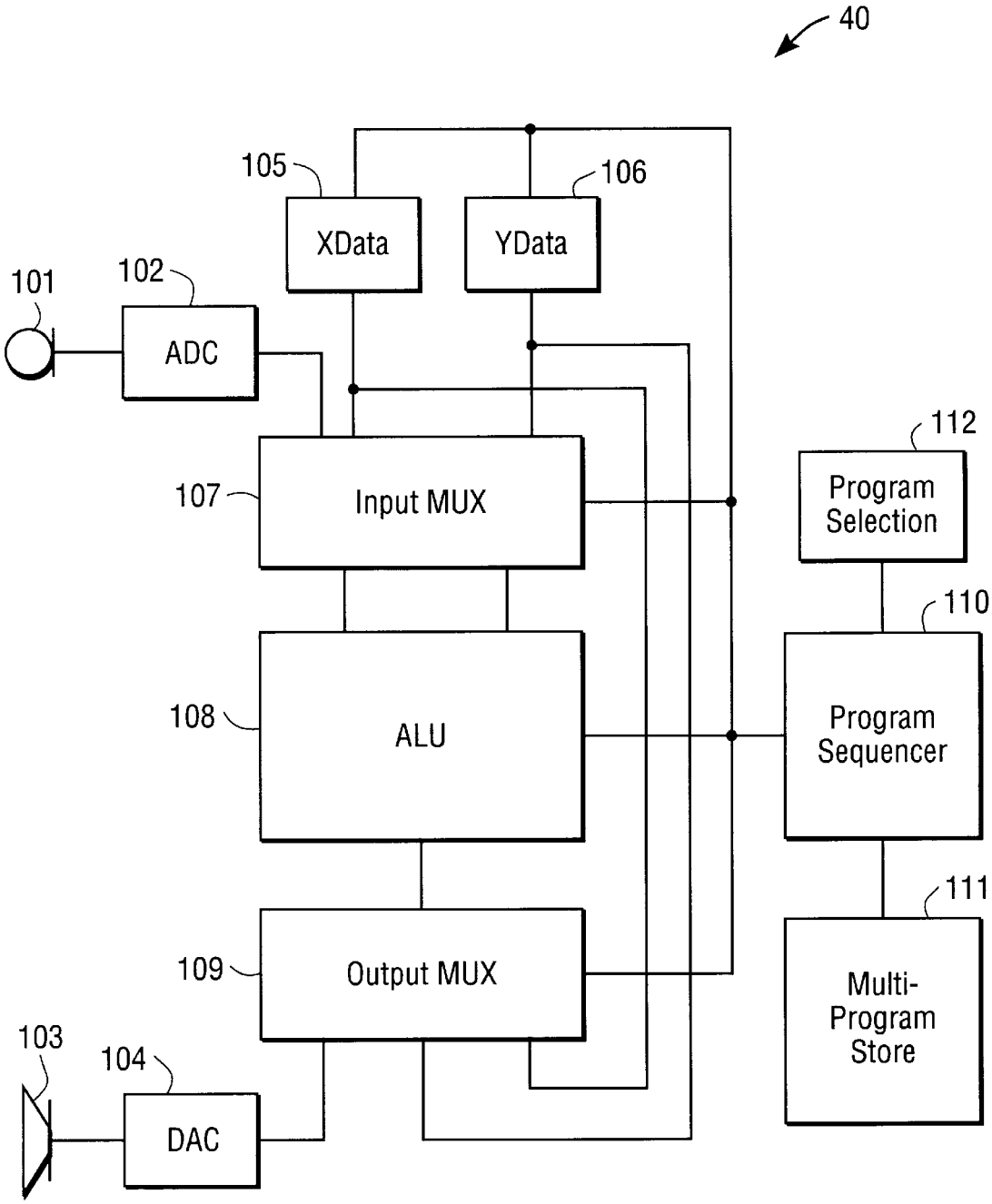
FIG. 1*b* is a block diagram of a preferred embodiment of the hearing aid of FIG. 1*a*.

Referring now to FIG. 1*b*, there is shown a preferred embodiment of the hearing aid of the present invention. FIG. 1*b* shows the main components of the hearing aid 40. This architecture is suitable for implementing a number of dynamic range compression strategies as well as other hearing aid rehabilitation strategies. Sound is input through an input transducer (101) and converted to a digital input stream by the Analog to Digital Converter (102). Calculations are performed on data from the input stream as well as data stored in X Data Ram (105) and Y Data Ram (106). These calculation are carried out by the Arithmetic Logic Unit (108) with the Input Mux (107) selecting which sources of data will be processed. The results of the calculations are fed back to the X or Y Data Rams (105, 106) or to the Digital to Analog Converter (104) which converts the signal to an analog output electrical signal suitable for driving the Output Transducer (103). Corresponding to each hearing aid rehabilitation strategy is a digital signal processing program which is stored in the Multi-program Store (111). Each program corresponds to a set of instructions which are interpreted by the program sequencer (110) and executed by ALU 108 to cause various actions to take place within the rest of the circuit. The Program Selection Switch (112) selects which rehabilitation strategy to activate. This switch is under control of the hearing aid wearer so that as he or she enters different listening environments, the appropriate strategy can be selected. At this point, it should be noted that each of the digital signal processing means 50 shown in FIG. 1*a* is implemented in the preferred embodiment as a digital signal processing program executed by the ALU 108. By switching between processing programs using program selection switch 112, the hearing aid wearer is in effect switching between the plurality of digital signal processing means 50.

Figure 2:
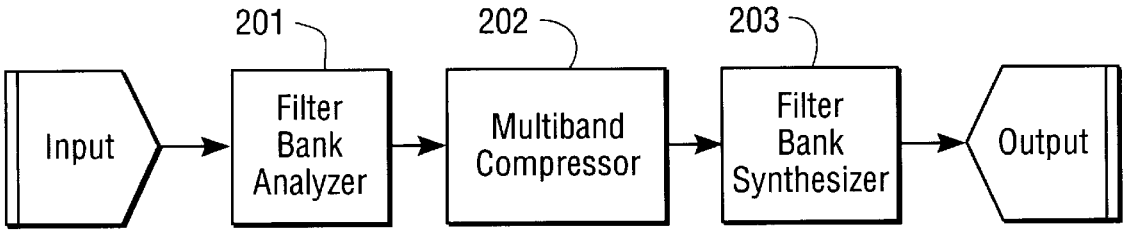
FIG. 2 is a functional block diagram of one of the digital signal processing means 50 of FIG. 1*a*.

A number of rehabilitation strategies are implemented as digital signal processing programs stored in the Multi-program Store. FIG. 2 shows the basic elements common to all of the rehabilitation strategies. The sound signal is input to a Filter Bank Analyzer (201) which divides the signal input into multiple frequency bands. The multiple frequency band signals are input to the multi-band processor (202) which processes the individual frequency band signals to affect their dynamic ranges. In the preferred embodiment, processor (202) performs a compression function; however, it should be noted that processor (202) may perform any desired function. The processed frequency band signals are then input to the Filter Bank Synthesizer/Combiner (203) which recombines the individual frequency band signals into a single output. Since these basic elements are implemented as digital signal processing programs, and the system provides for a plurality of programs that the user can switch between, it is possible to change filter structures by selecting different programs. For example, some algorithms, such as noise suppression algorithms, may require fine frequency resolution filter banks, whereas more simple compressors may require only two bands. These differences can be accommodated by switching digital signal processing programs. The following sections describe embodiments related to these three basic components. One of the motivations for the various filter bank embodiments is to achieve high frequency resolution, especially at low frequencies, without incurring large delay through the system. This issue will be discussed in conjunction with the various embodiments.

INCREMENTAL FFT FILTER BANK ANALYZER

Figure 3:
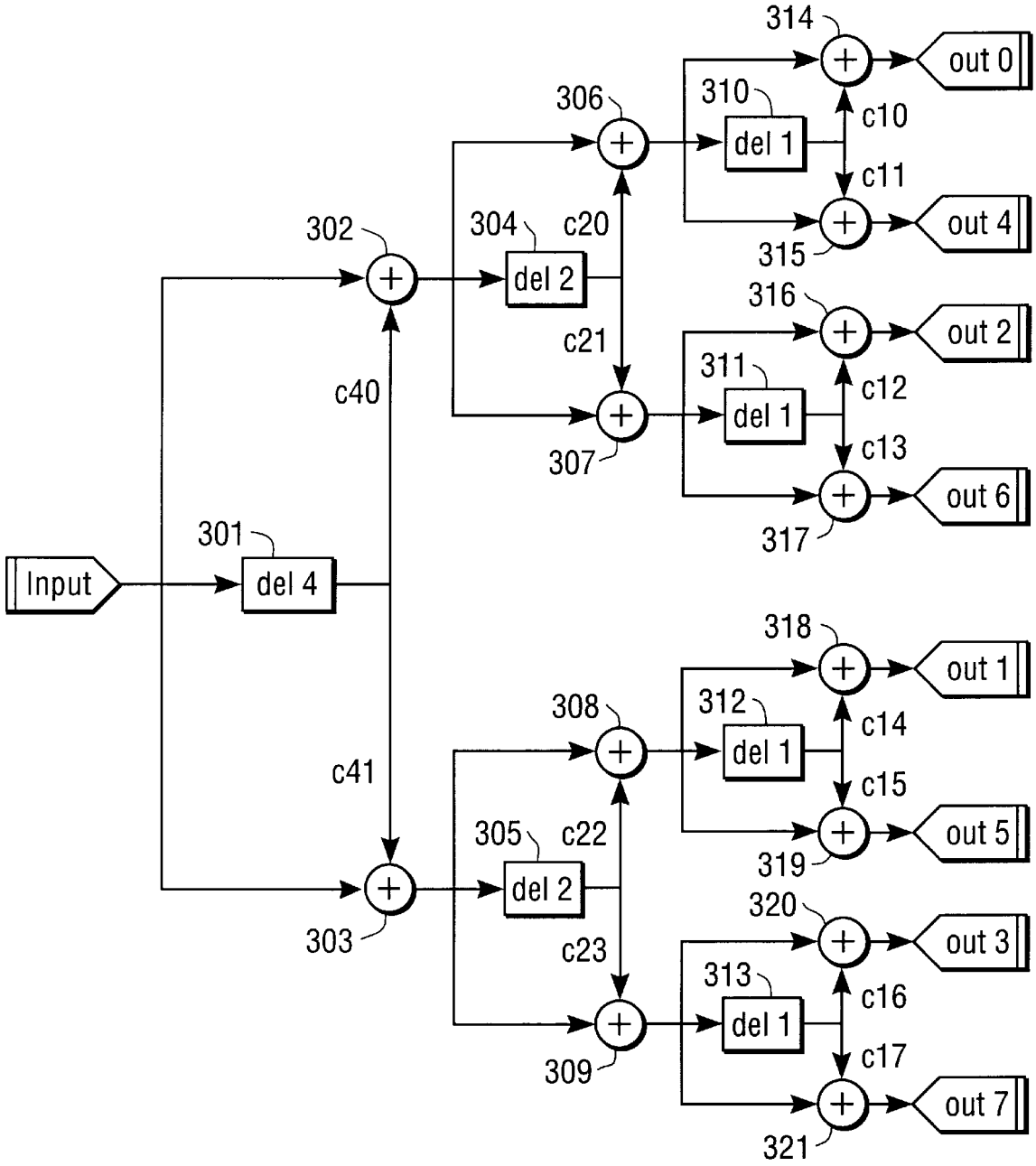
FIG. 3 is a functional diagram of an incremental FFT filter bank in accordance with the present invention.

FIG. 3 describes the first embodiment of a filter bank analyzer. The sum of a signal and a delayed version of itself form a comb filter with N filter lobes evenly spaced across frequency from 0 to the sample frequency (FSAMP). The peaks of the lobes of the comb filter are centered at k*FSAMP/N, with k ranging from 0 to N−1. The difference of a signal and a delayed version of itself also forms a comb filter with N evenly spaced lobes but now the peaks of the lobes are centered at (k*FSAMP/N)+FSAMP/(N*2), so that the lobe centers are shifted in frequency by half a lobe width. The magnitude frequency response of the sum of these two comb filters is flat, that is the comb filters are complementary and together they define 2*N frequency lobes ranging from 0 to FSAMP. A more general form of the comb filter is:

$$S+\text{delay}(S,N)\cdot cnn \tag{1}$$

where S is the input signal, delay( ) is a function which delays the signal by input parameter N, and cnn is a multiplier coefficient defined as:

$$cnn=e^{(j\cdot 2\pi\cdot N\cdot CENTER_FREQUENCY/FSAMP)} \tag{2}$$

which shifts the peak of the first frequency lobe to CENTER_FREQUENCY.

Figure 5:
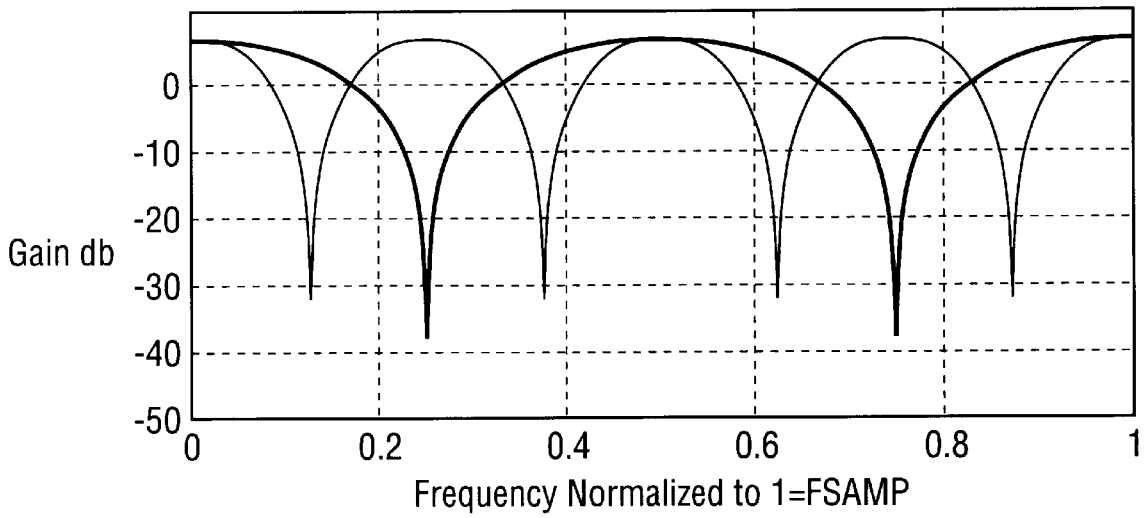
FIG. 5 is a plot of the superimposed magnitude frequency responses of comb filters 301, 302 and 304, 306 of FIG. 3.
Figure 6:
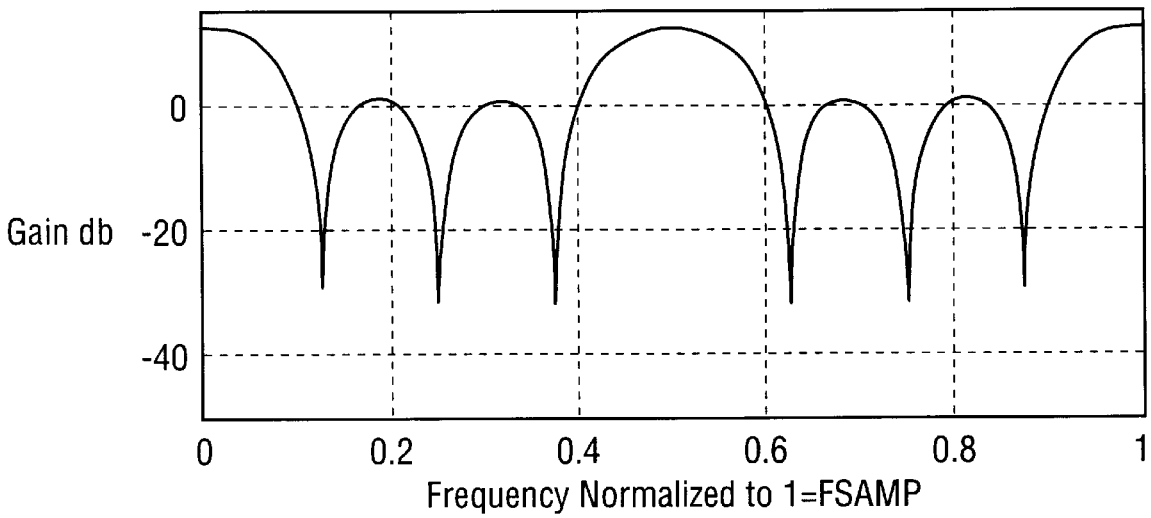
FIG. 6 is a plot of the composite frequency response seen at the output of adder 306 of FIG. 3.
Figure 7:
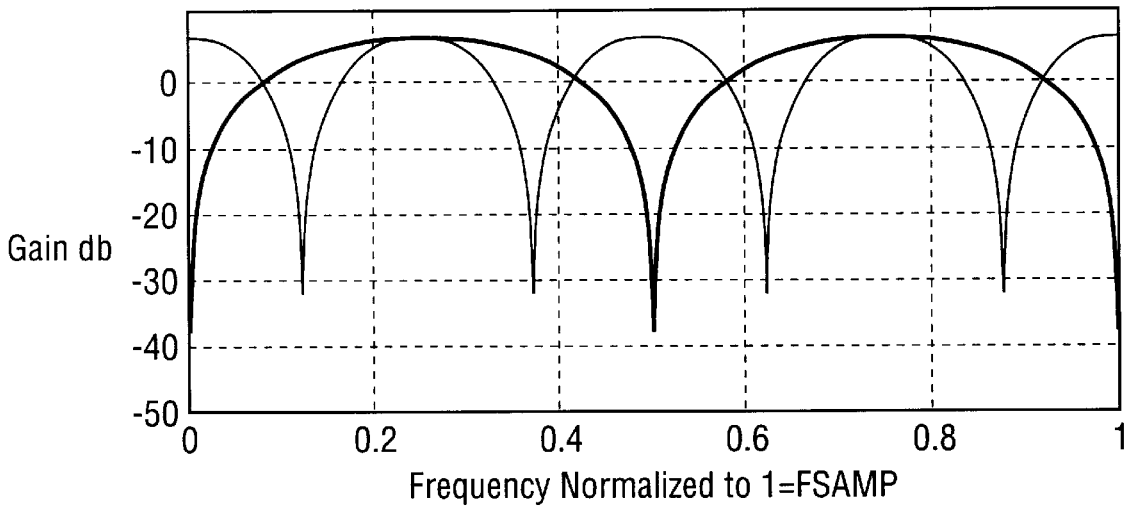
FIG. 7 is a plot of the superimposed magnitude frequency responses of comb filters 301, 302 and 304, 307 of FIG. 3.
Figure 8:
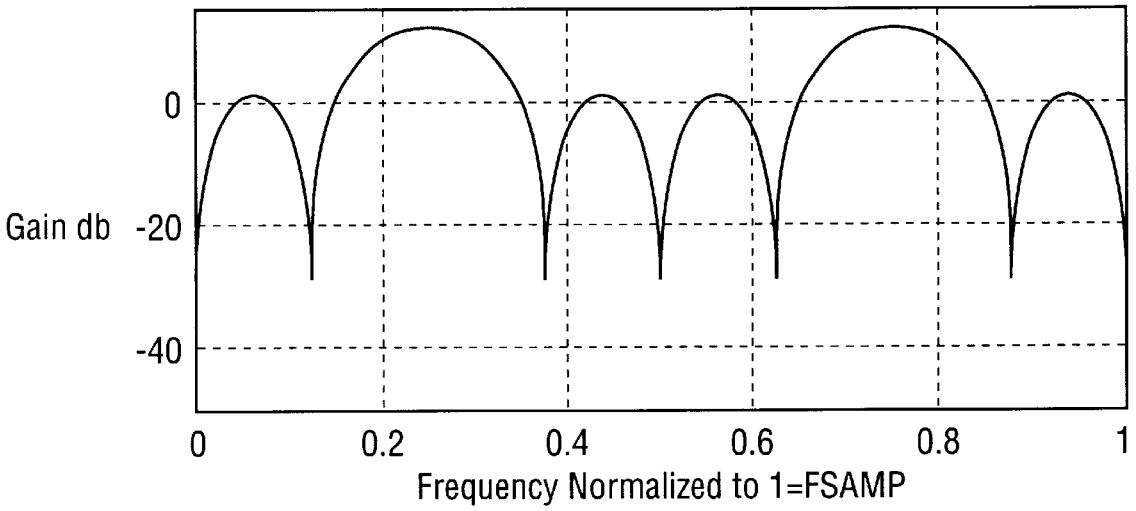
FIG. 8 is a plot of the composite frequency response seen at the output of adder 307 of FIG. 3.

In FIG. 3 the numbers c40, c41, c20, c21, c10, c11 etc. represent multiplier coefficients as defined in (2). Thus, the output of adder 302 is a comb filtered signal with delay N defined by 301 as 4. In this case c40=1 and c41=−1 so the output of adder 303 is the complementary comb filter with lobe centers shifted by FSAMP/(4*2). The output of 302 is then fed into another pair of complementary comb filters whose outputs are the adders 306 and 307 and multipliers c20=1 and c21=−1. The second stage comb filters defined by 304, 306, 307 and multipliers c20, c21 have lobe widths which are twice the width of the first stage comb filter with output 302 since 304 has delay 2 which is one half delay 301. Since the lobe width of the second stage comb filter 304, 306 is twice the first stage comb filter 301, 302, and since they both have their first lobes centered at frequency 0 then the second stage comb filter will have a zero at the peak frequency of the first stage comb filter's second lobe and all subsequent even number lobes. FIG. 5 shows the superimposed magnitude frequency responses of comb filters 301, 302 and 304, 306. With these two comb filters in series the composite frequency response seen at the output of adder 306 is shown in FIG. 6. In effect the second stage comb filter selects lobes 1, 3 of the first stage comb filter and suppresses lobes 2, 4. The second stage comb 304, 307 is the complement of comb 304, 306 since c21=−1 and its lobes are shifted in frequency by half the second stage lobe with, that is by one of the first stage comb widths. Therefore, second stage comb 304, 307 selects lobes 2, 4 of the first stage comb and suppresses lobes 1, 3. FIG. 7 shows the superimposed magnitude frequency responses of comb filters 301, 302 and 304, 307 and FIG. 8 shows the composite frequency response seen at the output of adder 307.

Figure 9:
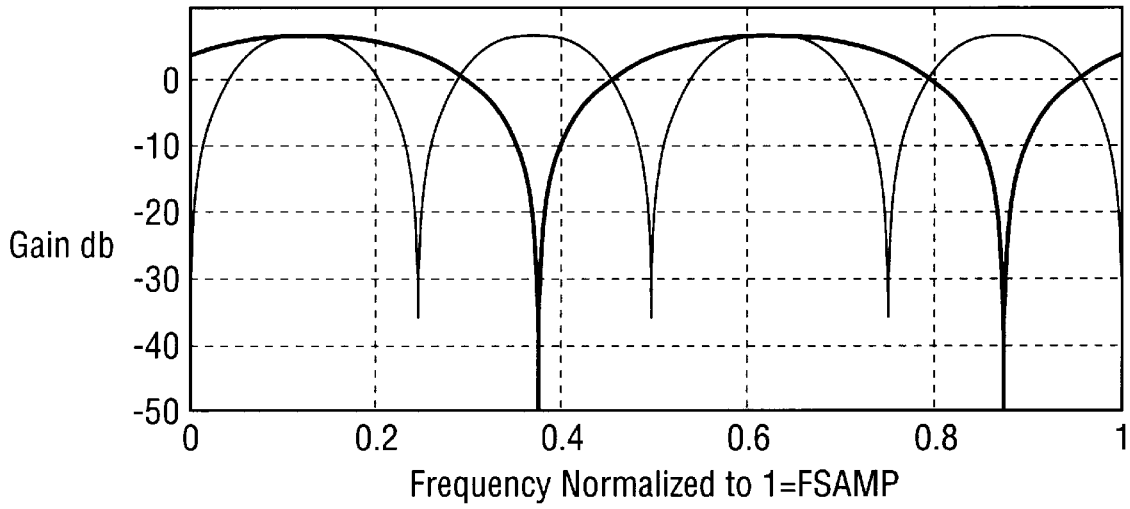
FIG. 9 is a plot of the superimposed magnitude frequency responses of comb filters 301, 303 and 305, 308 of FIG. 3.
Figure 10:
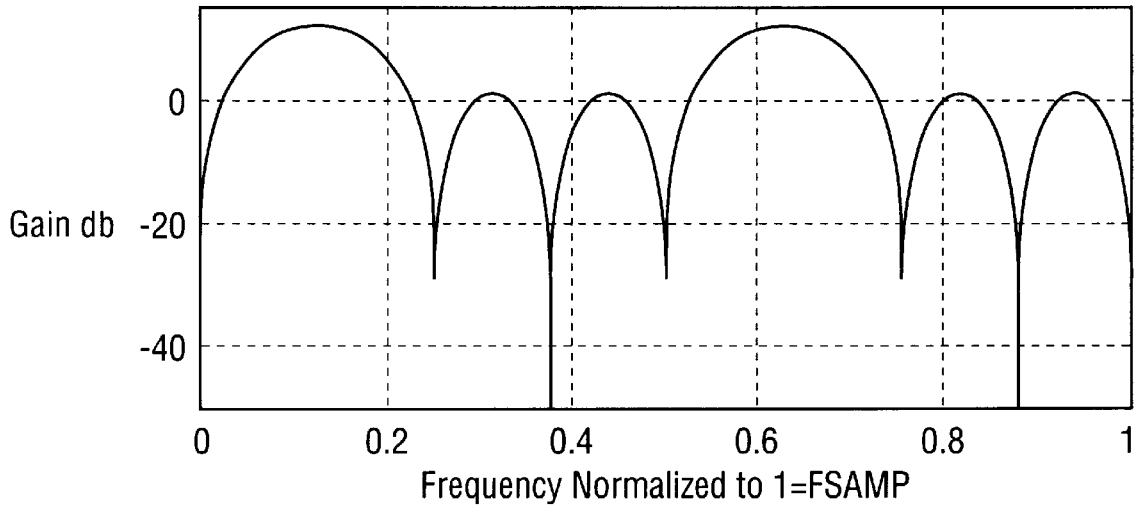
FIG. 10 is a plot of the composite frequency response seen at the output of adder 308 of FIG. 3.
Figure 11:
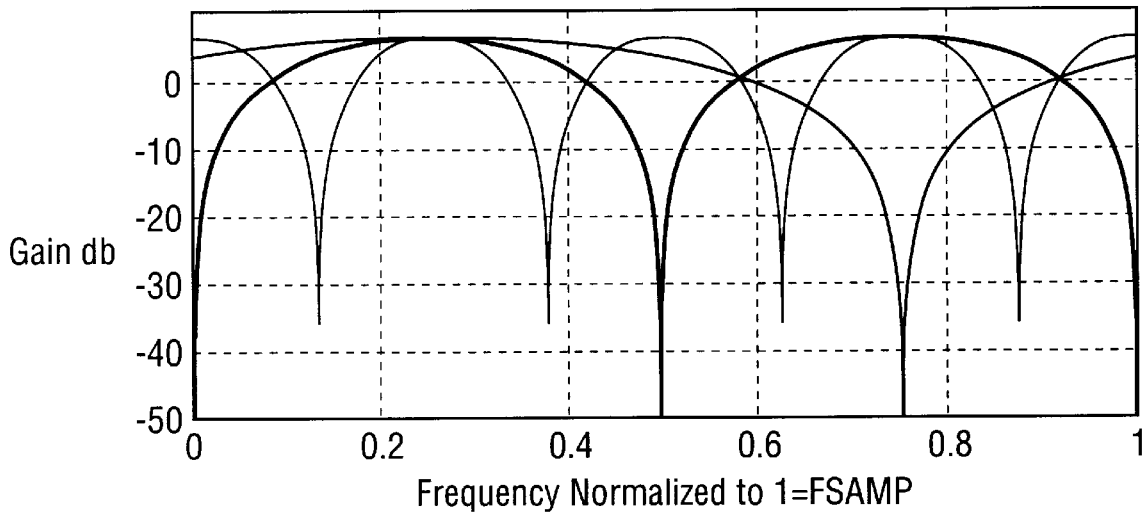
FIG. 11 is a plot of the three superimposed frequency responses shown in FIGS. 5, 7, and 9.
Figure 12:
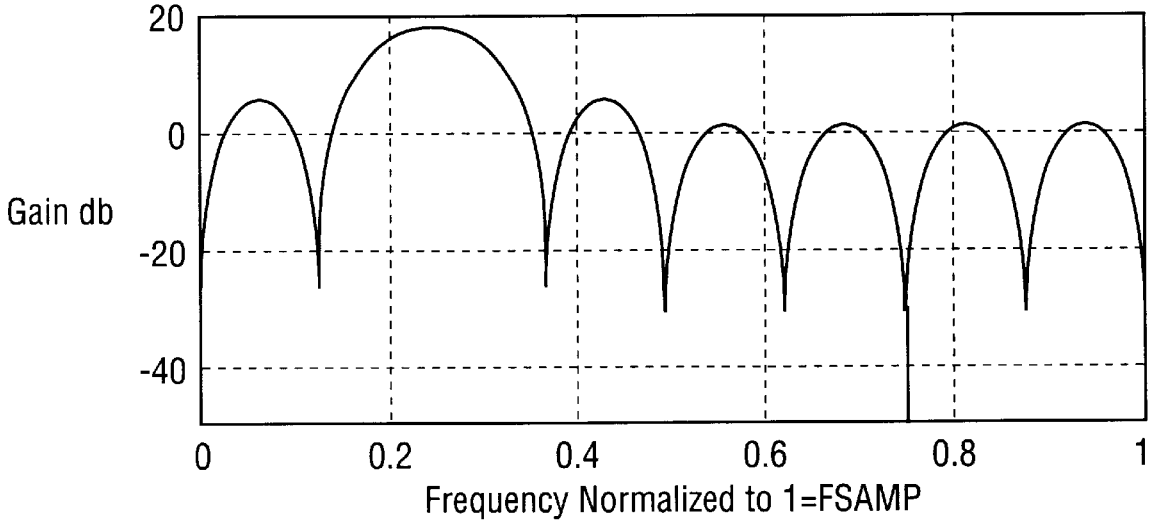
FIG. 12 is a composite frequency response of port out2 shown in FIG. 3.

The frequency response at the output of adder 303 is the complement of that at the output of adder 302 and is shifted by one half the first stage lobe width compared to the output of 302. The outputs of adders 308 and 309 are again complementary comb filters with lobe widths twice the width of the first stage comb, but now to select the even and odd lobes respectively of the output of adder 303 they must by shifted by 0.5 and 1.5 of the first lobe widths so that they will line up correctly with the output of adder 303. This means that c22=j and c23=−j where j=sqrt(−1). Thus the outputs of 308 and 309 are complex signals as will be the general case with this network. FIG. 9 shows the superimposed frequency responses of combs 301, 303 and 305, 308 and FIG. 10 shows the composite frequency response seen at the output of adder 308. At the output of adders 306 through 309 there are 4 frequency responses each one selecting two of the original (N*2=8) lobes defined by the first stage comb filters. By continuing this process of doubling the lobe width and shifting lobe centers, a third stage of comb filters with delays of 1 is added providing eight outputs, each selecting one of the original eight lobes as defined by the first stages comb filters. This requires complex multipliers c10–c17 selected appropriately. FIG. 11 shows the three superimposed frequency responses and FIG. 12 shows the composite frequency response leading to out2 which is the third lobe of the original eight.

The outputs of the system of comb filters defined in FIG. 3 are identical to those of an 8 point Complex Fourier Transform. In effect the system is the implementation of an Incremental Complex Fourier Transformer with rectangular window. It is incremental because for every new input sample a new set of output transform samples is generated. By adding additional comb filter stages in front of the first stage shown in FIG. 3, and by expanding the comb filter tree appropriately, longer Fourier Transforms can be calculated. The number of frequency points of the Fourier Transform is 2*N where N is the delay of the first stage comb.

The group delay of the Incremental Complex Fourier Transformer is the sum of the series interconnection of the combs. Each comb filter has a group delay equal to ½ the delay length. So for an N*2 point Fourier Transform the total group delay is N/2+N/4 . . . +½ which is equal to N−0.5. Thus, the 8 point FFT system has a delay of 4−0.5=3.5 samples. A typical block based implementation of a Short Time Fourier Transform system with a 2 to 1 overlap of successive FFT frames has a total delay of 3*(N) where N*2 is the FFT window length. This delay is due to system buffering requirements. This is more than 3 times the length of the optimal Incremental Fourier Transform system. A system for implementing a 256 point FFT would have delays of 384 samples in the block case and 127.5 samples in the Incremental Fourier Transform case.

HYBRID COMB FILTER/RESONATOR FILTER BANK ANALYZER

Figure 4:
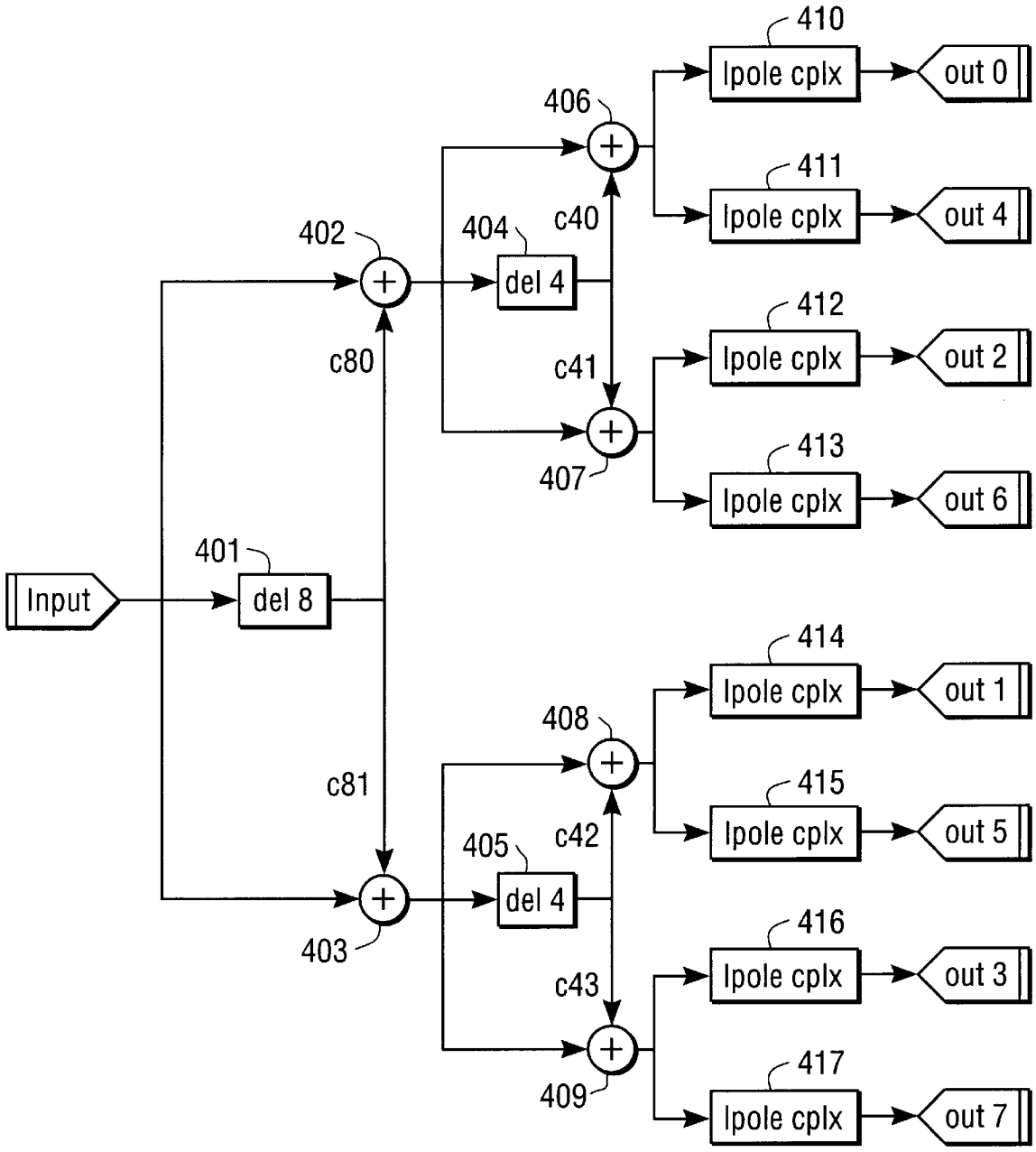
FIG. 4 is a functional diagram of a hybrid filter bank in accordance with the present invention.

In FIG. 4 elements 401 through 409 implement two comb filter stages similar to those described for FIG. 3; however, now the delay is N=8 so the system should have 2*N=16 frequency output points.

Figure 13:
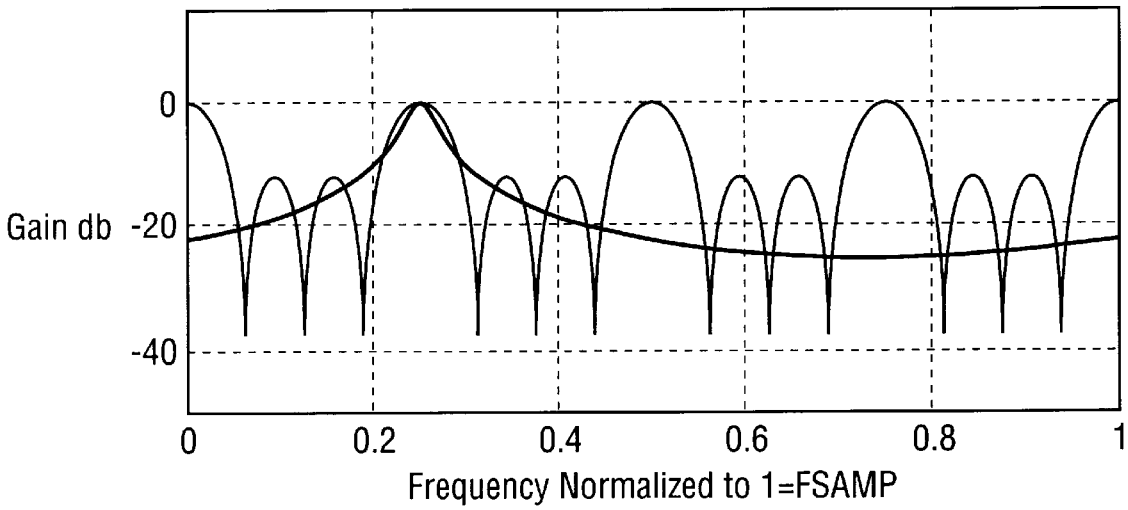
FIG. 13 is a plot of the magnitude frequency response of a complex filter tuned to FSAMP/4 superimposed on the frequency response seen at the output of adder 406 shown in FIG. 4.
Figure 14:
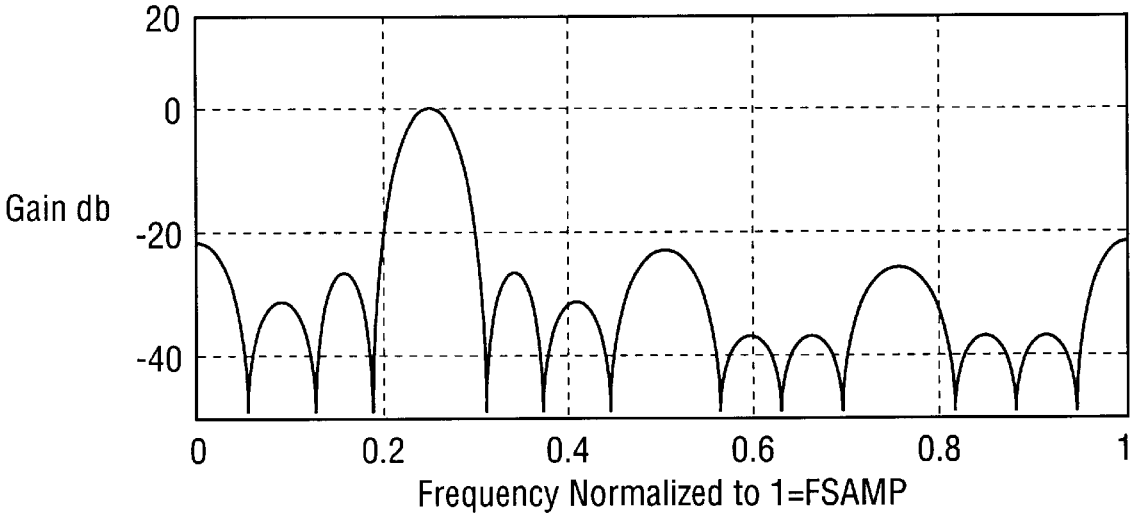
FIG. 14 is a plot of the composite frequency response seen at the output of the complex one-pole 441 shown in FIG. 4.

The frequency responses seen at the output of adders 406 through 409 each select 4 out of the 16 lobes defined by the first stage comb filters. Now, however, instead of continuing the system of comb filters another 2 stages to have sixteen outputs each with 1 lobe selected we instead apply recursive resonator filters to the outputs of adders 406 through 409. In the preferred embodiment, these filters take the form of one-pole complex resonators; however, it should be noted that other types of filters may also be used. The complex one pole filter is defined as:

$$y(n)=(1-c)\cdot x(n)+c\cdot y(n-1)$$

where all quantities are complex. FIG. 13 shows the magnitude frequency response of a complex filter tuned to FSAMP/4 superimposed on the frequency response seen at the output of adder 406. FIG. 14 shows the composite frequency response of the two filters seen at the output of complex one pole 411. The filter feedback coefficient of the complex one pole was set to 0.9 in FIG. 14. In general the value of the coefficient defines the sharpness of the selected lobe, with sharper lobes giving greater isolation from band to band but more ripple in the total filter bank response. Note that while it is possible to apply 4 different complex one pole filters to the output of each adder 406–409, in fact, only two are applied because it is only desired to acquire samples for frequencies 0 through FSAMP/2 of a real input signal. In some situations where the system is applied to a complex input signal, all complex one pole signals can be applied.

Figure 15:
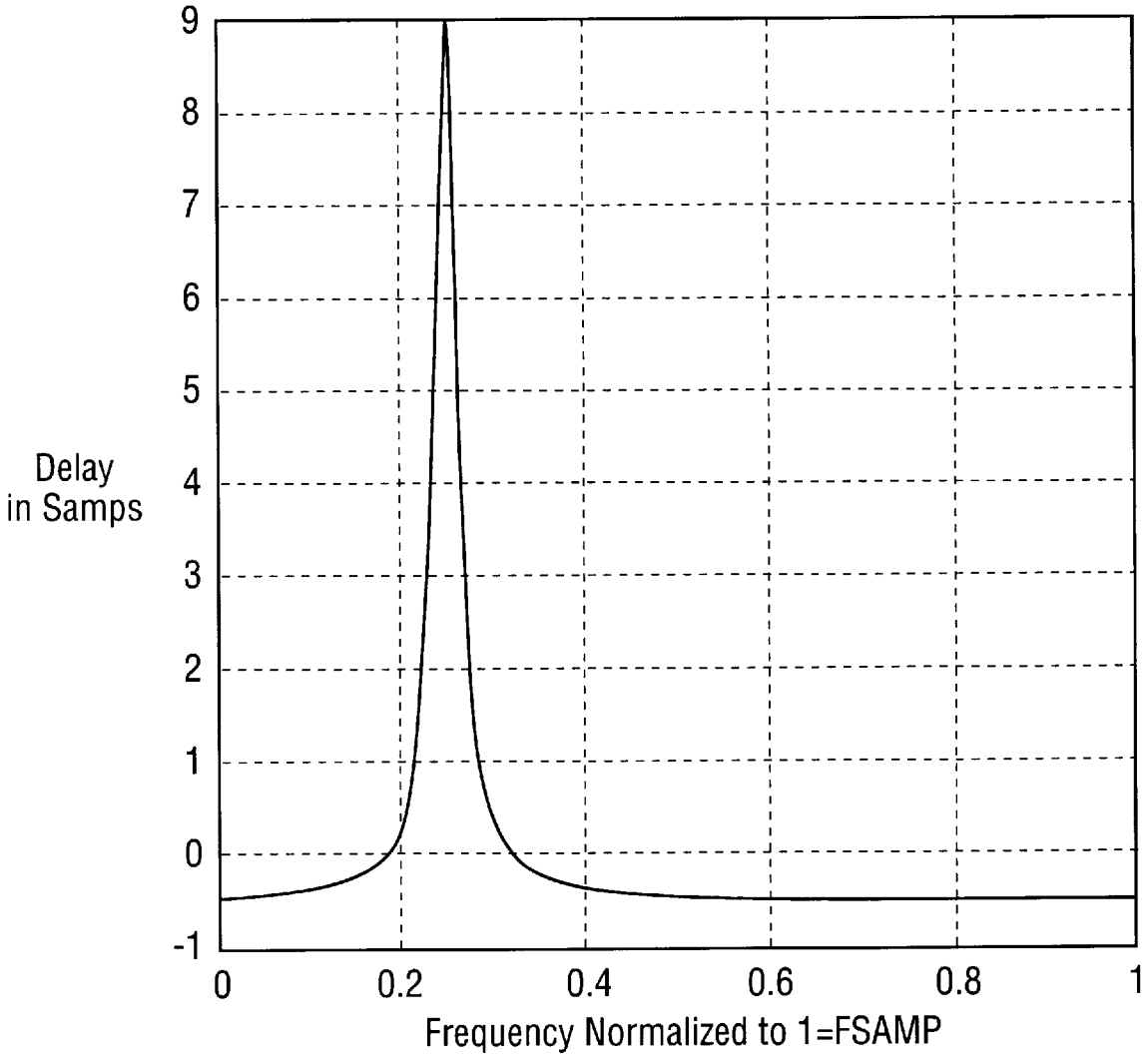
FIG. 15 is a plot of the group delay of a complex one-pole resonator with a 0.9 coefficient in a hybrid filter bank equivalent to a 256 point FFT.

In general, given an Incremental Fourier Transform system of arbitrary order, it is possible to cut the system after some number of comb filter stages and then apply complex one pole resonators to select frequency lobes. A system for implementing the equivalent of a 256 point FFT, that is 128 frequency bands from 0 to FSAMP/2, can have two stages of comb filters followed by 128 complex resonators. The group delay is equal to the series connection of the two comb filter stages followed by the complex resonator. FIG. 15 shows the group delay of the complex one pole with 0.9 coef. It has a peak value of 9 samples and an average value of approximately 1 sample. The overall delay of the 256 point system would be 128/2+64/2+9=104 in the worst case compared to 127.5 for the Incremental Fourier Transform case. The disadvantage is that the group delay is not flat which can create a reverberation artifact if the feedback coefficient of the complex one poles is too close to one causing very sharp resonators with large peaks in group delay.

Often it is desirable to have filter banks with unequal spacing of bands across frequency. In particular, a spacing similar to the ears' critical bands (approximately 100 Hz spacing below 500 Hz and approximately third octave above) is often desirable. While this kind of quasi-constant Q spacing is not easily achievable with the comb filter structure, it is possible to grossly approximate nonlinear spacing by having more than one comb filter system in parallel. Note that in the Hybrid Comb Filter/Resonator structure with only two comb filter stages, the bulk of the computation is in the complex one pole filters. Therefore, in another embodiment of the Hybrid Comb Filter/Resonator there are two 2 stage comb filter systems in parallel with N=8 and N=4 respectively for the two systems. The N=8 comb filter system has complex one pole filters only in the lower half band, while the N=4 comb filter system has complex one pole filters only in the upper half band. It should be clear to one skilled in the art that it is possible to have more than two comb filter systems in parallel, and that the delay lengths for two stage systems can be any even number allowing for a wide variety of nonlinear frequency spacing configurations.

HYBRID BANDSPLITTER FILTER BANK ANALYZER

While the Incremental Fourier Transform and Hybrid Comb Filter/Resonator Filter banks are effective for reducing delay compared to a block oriented Short Time Fourier Transform, they are still costly in terms of computation. An approach to alleviating this is to first divide the spectrum into a relatively small number of bands (e.g. 4) and then apply the above mentioned filter bank techniques within those sub-bands that require more frequency resolution, such as the lowest frequency bands. Efficient bandsplitter filters based on allpass filter structures have been proposed (See P. P. Vaidyanathan, MULTIRATE SYSTEMS AND FILTER BANKS, PTR Prentice Hall, Englewood Cliffs, N.J., 1993). The text of this reference is incorporated herein by this reference. The bandsplitter divides a signal into a highpass and lowpass signal with crossover at the mid frequency point of the band. The bandsplitters proposed are power symmetric meaning that the magnitude frequency response of the sum of the two filters is perfectly flat. However the phase response of the filters is not linear so that, like the complex one pole resonators described above, the system will have peaks in the group delay at the crossover bands of the bandsplitters.

Figure 16:
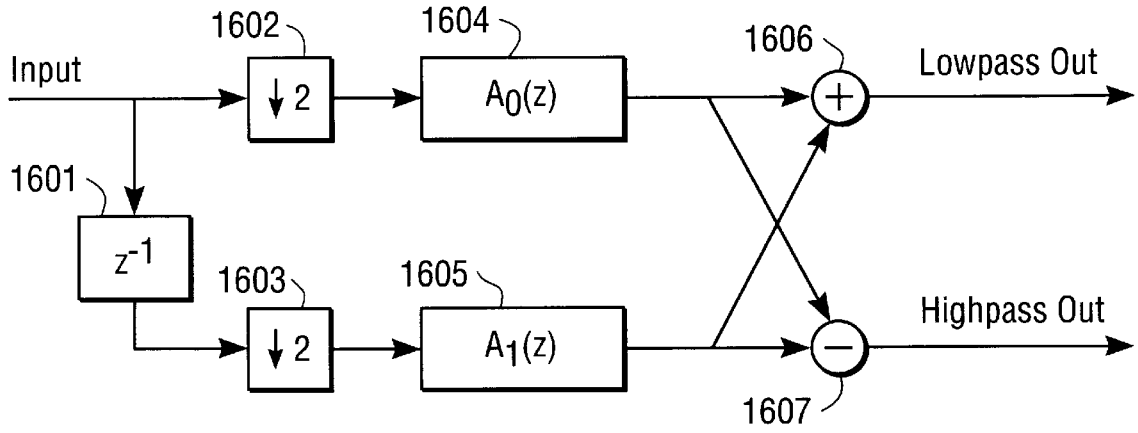
FIG. 16 is a block diagram representation of a bandsplitter in accordance with the present invention.

FIG. 16 shows the structure of the allpass bandsplitter. Since the low and high pass signals each have half the bandwidth of the input signal they can be decimated by a factor of 2 in sample rate. The allpass filters (1604, 1605) for the bandsplitters have the special property that the filter coefficients for odd numbered powers of Z, ($Z^{-1}$,$Z^{-3}$, . . . ), are all zero. Because of this special property it is possible to move the decimators (1602, 1603) in front of the allpass sections 1604, 1605. In this way the computation rate of the allpass section is halved. In practice, rather than providing explicit decimators, one path is fed with the even number points and the other, because of the unit sample delay operator (1601), receives the odd points. In fact, some aliasing may occur due to this decimation process because the filters are not ideal bandsplitters and have a finite transition band over which aliasing can occur. A discussion of aliasing minimization will occur later in this section. It has been shown by Vaidyanathan (previously cited) that a ninth order elliptical bandsplitter can be implemented with 2 second order allpass sections.

The intention is to split the original signal into low and high bands and then split the low band again to create low low (LL) bands and low high (LH) bands. Then the LL and LH bands will be further divided by inputting them to separate filter banks either of the Incremental Fourier Transform type as in one embodiment or the Hybrid Comb Filter/Resonator type as in another embodiment.

As described above the two filter bank types operate on complex values; therefore, it can be desirable to convert the real signals to complex signals before inputting them to the filter banks. The conversion to complex also has advantages in terms of quantization of filter coefficients in the allpass bandsplitters.

In any embodiment involving complex signals it is necessary to convert from real to complex. This is done using a Hilbert transformer which generates a pair of signals which are in quadrature (90 degree phase lag) relationship across the usable frequency band. One of the pair is the real part of the complex signal, and the other of the pair, lagging by 90 degrees, is the imaginary part. Together this complex pair is referred to as the analytic signal. It should be noted that referring to this pair as complex is a mere convenience. It is quite possible to generate two real signals in quadrature relationship and then continue to process them in a manner identical to that described in this patent without ever referring to them as complex with an identical result and system structure. Therefore, without loss of generality, this disclosure will continue to refer to complex signals, and it is to be understood by those skilled in the art that this can apply to systems involving real signals in quadrature relationship without a fundamental change of structure.

Figure 33:
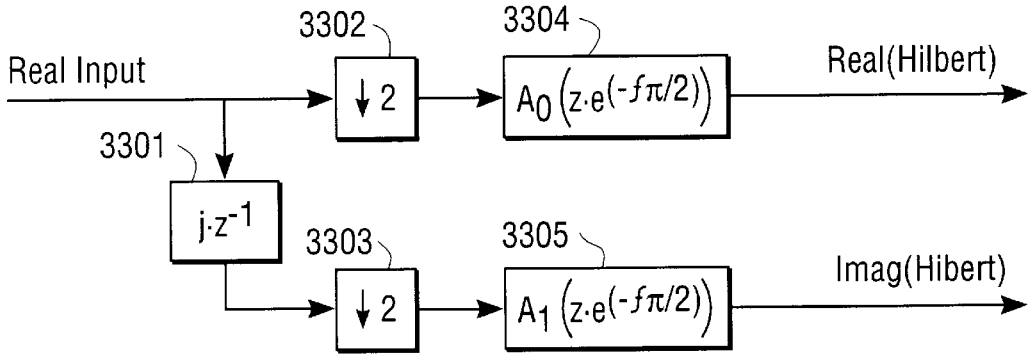
FIG. 33 is a functional representation of a Hilbert transformer in accordance with the present invention.

The spectrum of a real signal is conjugate symmetric with the interval from frequency 0 to −FSAMP/2 being the conjugate mirror of the interval from 0 to FSAMP/2. An analytic signal generated directly from this signal is ideally identical in the interval 0 to FSAMP/2 but the interval 0 to −FSAMP/2 is zero. So the ideal Hilbert transformer is a rectangular filter with unity gain from 0 to FSAMP/2 and 0 gain from 0 to −FSAMP/2. This rectangular shape is the same as an ideal real-valued lowpass filter which has been shifted in frequency by FSAMP/4. The allpass bandsplitters described above provide an efficient structure for implementing a lowpass filter. Shifting the frequency response by FSAMP/4 should provide the desired Hilbert Transformer. Note that since the Hilbert Transform process results in zeroing half the spectrum, it is then possible in the ideal case to decimate the signal by 2 without loss of information, in which case the interval from 0 to FSAMP after Hilbert Transformation and decimation will be the same as the interval from 0 to FSAMP/2 of the original real signal, and this 0 to FSAMP will be repeated at every multiple of the decimated FSAMP. In practice, some aliasing will occur due to decimation just as in the bandsplitter case. As with the real bandsplitter described above because of the special properties of the allpass sections used in the Hilbert Transformer it is possible to move the decimators in front of the allpass sections. FIG. 33 shows the structure of the Hilbert Transformer which is seen to be similar to the bandsplitter structure. The shift in frequency is accomplished by multiplying the delay operator 3301 by j and modulating the filter coefficients in 3304 and 3305 by the sequence exp(j*pi/2*n), where n is the index of the coefficients beginning with zero. In this sequence, the j terms land on the odd numbered powers of Z which as we have already indicated are zero for the allpass bandsplitter filters if the decimation occurs after the filters. In this case since the decimation occurs before the filters, the odd numbered zero coefficients simply disappear and the number of coefficients is halved. Therefore, the modulation of the lowpass, highpass real valued filter coefficients is accomplished by negating every other coefficient of the allpass filters when they occur after decimation by 2 as in FIG. 33 so that the resulting filters still have all real valued coefficients. Typically the two band outputs of the bandsplitter are formed by taking the sum and difference of the outputs of the two allpass sections as in 1606, 1607 of FIG. 16. In the case of FIG. 33, since we are interested only in a single Hilbert Transformed complex output, this corresponds to the lowpass, summed output of the frequency shifted allpass sections. Since the input to the upper allpass section (3304) is pure real, and the input to the lower allpass section (3305) is pure imaginary due to the multiplication by j in 3301, the sum of these two outputs is simply a complex stream made up of the two allpass section outputs: real for the top allpass and imaginary for the bottom allpass. This is the decimated analytic signal.

Figure 34:
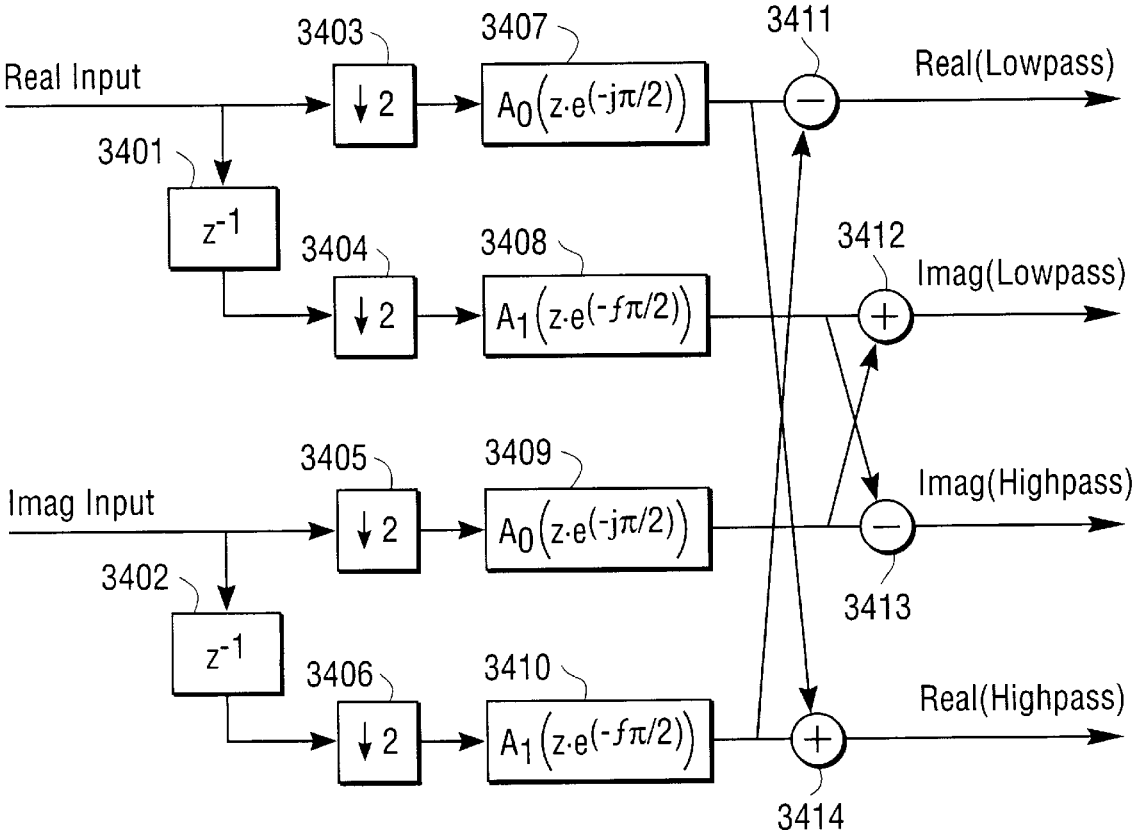
FIG. 34 is a functional representation of a system which results when the bandsplitter shown in FIG. 16 is provided with a complex input and is partitioned into its real and imaginary parts.

In several embodiments to be described, the input to a bandsplitter stage is itself complex, being the output of a Hilbert transformer or a previous complex bandsplitter stage. In this case, the signals are analytic signals which have been decimated by 2 so that the useful pass band of the complex spectrum extends from 0 (lowest frequency) to FSAMP (highest frequency), not FSAMP/2 as for a real signal, and is periodic at intervals of FSAMP as described above. Therefore, splitting the low and high bands requires a lowpass filter with pass band from 0 to FSAMP/2 and stop band from FSAMP/2 to FSAMP, and a highpass filter with stop band from 0 to FSAMP/2 and pass band from FSAMP/2 to FSAMP. The lowpass filter in this case is seen to be identical to the Hilbert Transformer and the high pass is its complements If the bandsplitter structure of FIG. 16 is provided with a complex input, and if the resulting system is partitioned into its real and imaginary parts, the system of FIG. 34 results. Note that since the allpass coefficients are real-valued, it is possible to process the real and imaginary part of the input separately through two identical pairs of allpass filters 3407, 3408 and 3409, 3410. Taking the sums and differences of the real and imaginary outputs of the allpass sections and pushing the multiply by j of the delay operators (3401, 3402) to the output is equivalent to the summing and differencing network shown in FIG. 34 (3411–3414). In particular, no non-trivial complex multiplies are required to implement the complex bandsplitter and the required computation is exactly twice that of the real bandsplitter with possible additional savings due to identical coefficients in the real and imaginary allpass sections.

Figure 18:
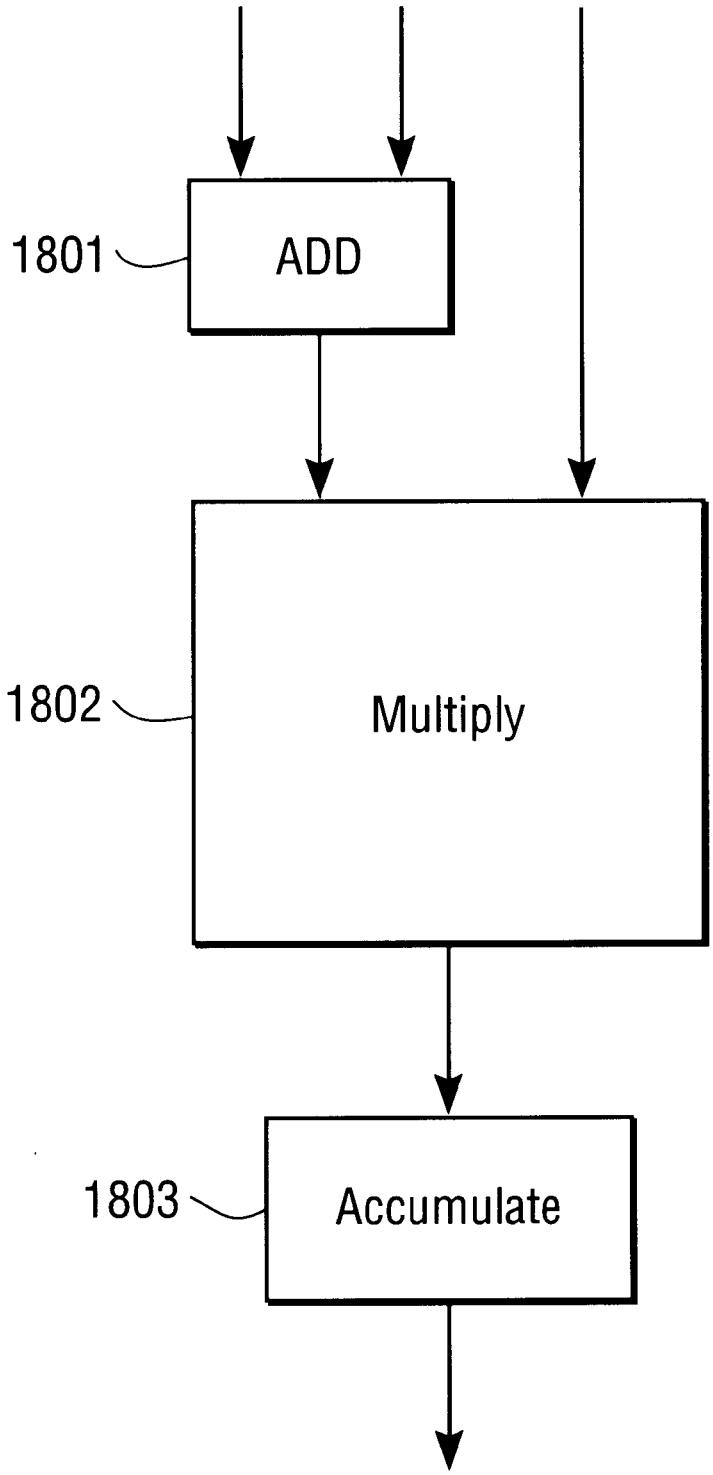
FIG. 18 is a functional representation of an arithmetic logic unit in accordance with the present invention.

The standard DSP Arithmetic Logic Unit (ALU) has two operand inputs to a multiplier and an accumulator following the multiplier. This is an excellent architecture for many DSP algorithms but the allpass bandsplitters described above are awkward to implement with this structure. However, by placing an additional adder in front of one of the ALU inputs the allpass bandsplitter architecture becomes much simpler to implement. FIG. 18 shows the structure of the DSP ALU for the preferred embodiments described herein.

Figure 19:
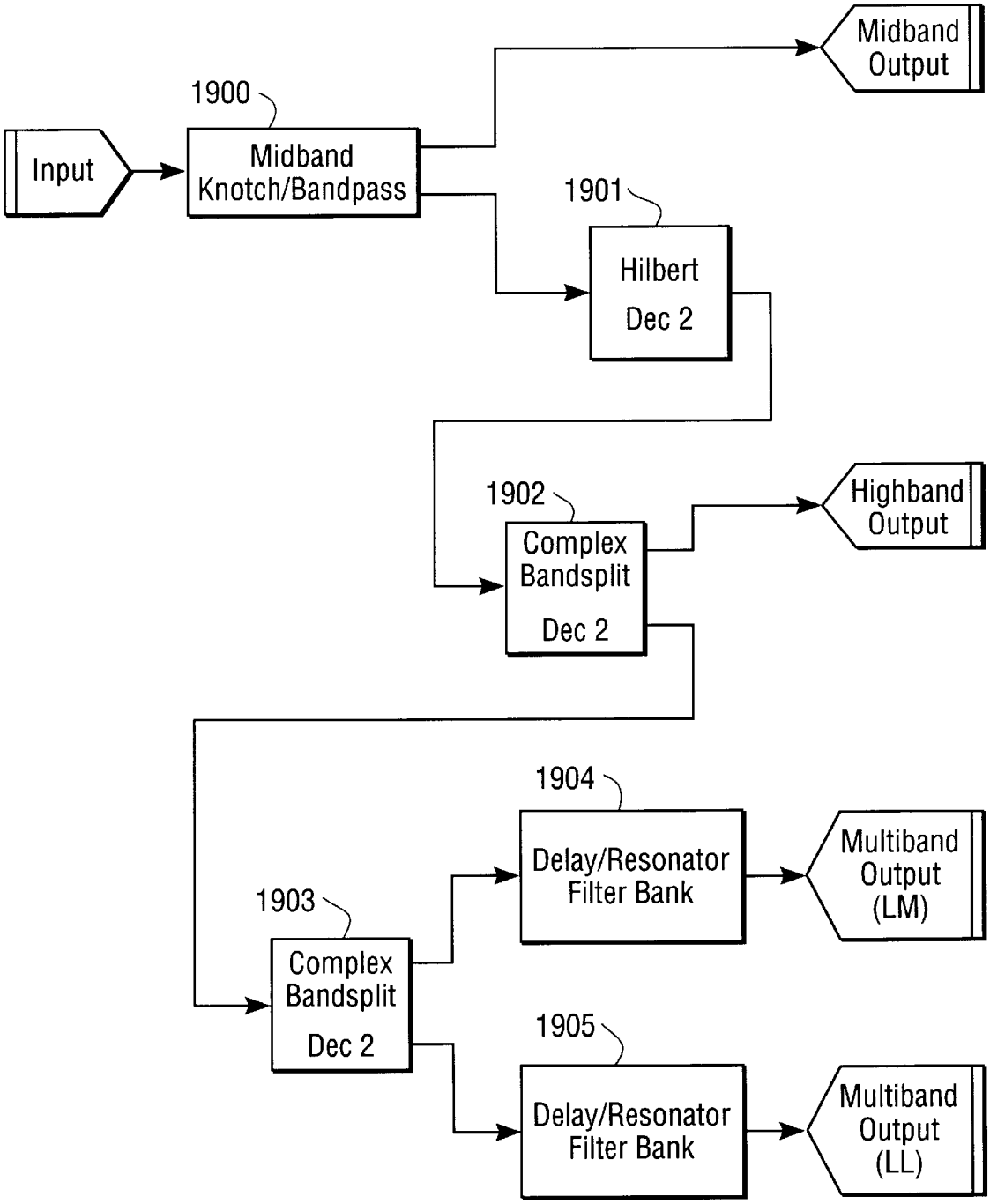
FIG. 19 is a functional representation of a first embodiment of the hybrid bandsplitter filter bank analyzer of the present invention, wherein a midband notch/bandpass filter is utilized.

FIG. 19 shows one embodiment of a Hybrid Bandsplitter Filter Bank Analyzer (HBIFFT). The input signal is first input to the Midband Notch/Bandpass filter (1900) which will notch a small band from the mid frequency point FSAMP/4 and deliver this notched band as a separate output from the filter bank. The purpose of this will be described below. The main wideband output of 1900 is fed to the Hilbert Transformer (1901) where it is decimated by 2 and converted to an analytic (complex) signal. This is justified as described above. The output of the Hilbert Transformer (1901) is then fed to the complex bandsplitter (1902) where the high and low bands are generated and each are decimated by 2. The highband complex signal is output from the filter bank and the low band complex signal is fed through another stage of decimation and complex bandsplitting (1903) and then the low low (LL) and low high (LH) bands are fed to separate Filter Banks (1904, 1905). In the embodiment of FIG. 19, these filter banks are Hybrid Comb Filter/Resonator types but they can easily be Incremental Fourier Transform types or any other filter bank structure with no loss of generality.

Figure 27:
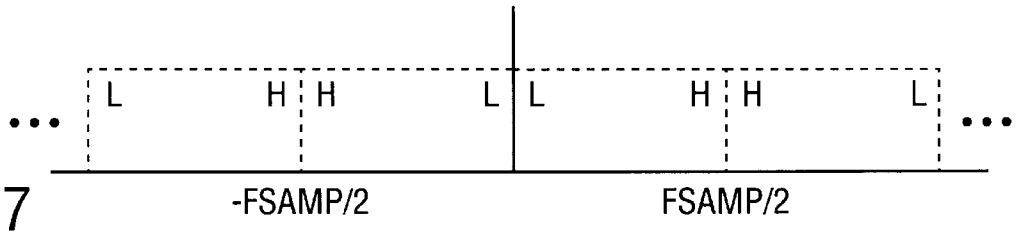
FIGS. 27–32 are spectra patterns of various signals showing the results of decimation.
Figure 28:
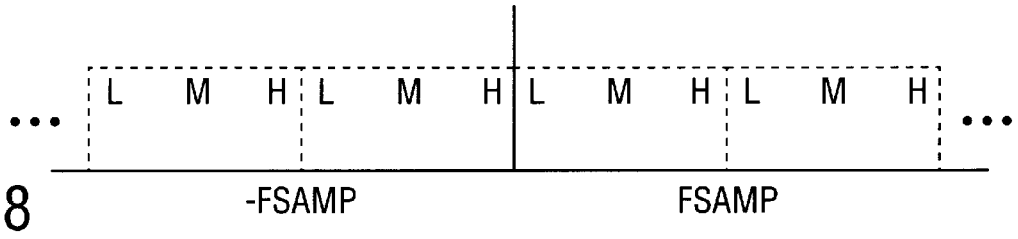
Figure 29:
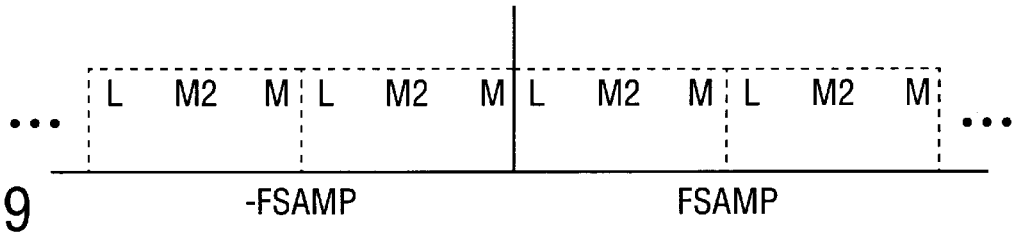
Figure 30:
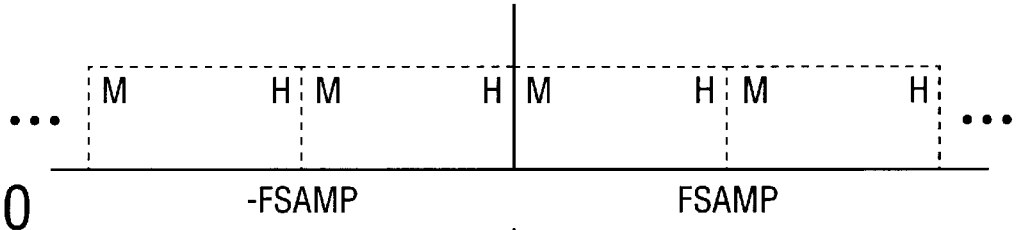
Figure 31:
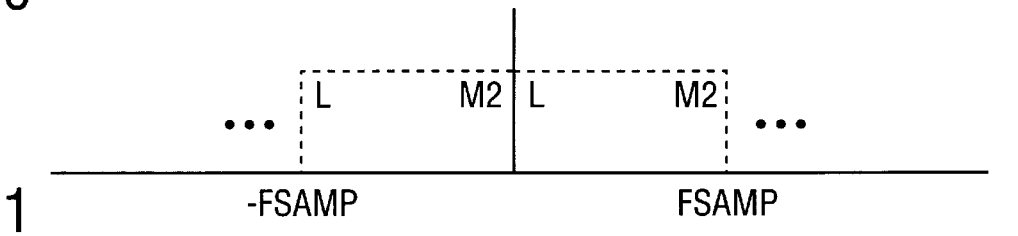
Figure 32:
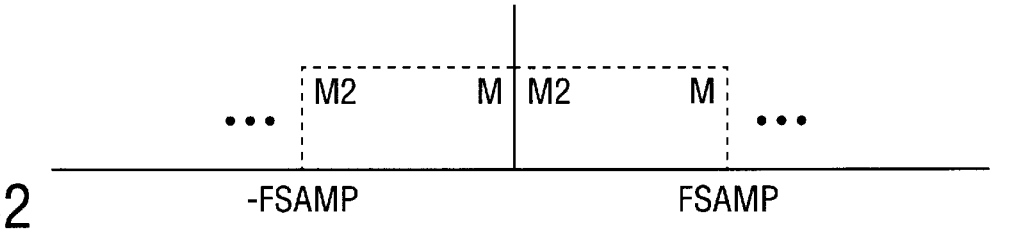

Bandsplitting or Hilbert Transforming a signal and decimating by 2 causes no aliasing in the ideal case. However, in practice, aliasing will occur near the transition bands. FIGS. 27 through 32 show the pattern of spectra for the various cases of decimation. FIG. 27 shows the discreet spectrum of a real signal. L indicates the lowest frequency and H indicates the highest frequency at FSAMP/2. FIG. 28 shows the spectrum after Hilbert transformation and decimation by 2. The FSAMP in FIG. 28 is with respect to the decimated sample rate, that is, FSAMP of FIG. 28=FSAMP/2 of FIG. 27. Note that the highest frequencies of the original spectrum are adjacent to the lowest frequencies and the spectrum extends from 0 to FSAMP. In FIG. 28, M indicates the mid frequency point halfway between L and H. To the extent that the Hilbert filter is non-ideal and has a non-zero width transition band, there will be aliasing in the overlap region between the highest and the lowest frequencies. In practice, due to limitations of input transducers, the response of any practical hearing aid instrument does not extend down to 0 frequency but rather begins at approximately 100 to 150 Hz. Thus, there is a small "don't care" region at the lowest frequencies which can provide a margin of safety from aliasing. Specifically, the low frequencies which fold into the high are nonexistent and the high frequencies which fold into the low can be filtered out provided the folding is below the 100 to 150 Hz band. Since the LL band of lowest frequencies is to be further divided by fine frequency resolution filter bank (1905 in FIG. 19) it is possible to zero out the lowest one or two bands of this fine resolution filter bank to accomplish the desired aliasing protection. The output of the Hilbert Transformer will be fed to a complex bandsplitter. As described above the complex bandsplitter divides the complex spectrum into two halfbands from 0 to FSAMP/2 and FSAMP/2 to FSAMP. The two halfbands are then decimated. FIG. 29 and FIG. 30 show the lowpass and highpass, respectively, halfband outputs of the complex bandsplitter after decimation. In the low band, L is adjacent to M, the mid frequency point, and in the high band, M is adjacent to H. Since the bandsplitter is non-ideal there will be aliasing around these adjacent regions. The Midband Notch/Bandsplitter (1900 in FIG. 19) is responsible for removing a small band region around M=FSAMP/4 and sending it as undecimated side information which will be separately processed. This protects against aliasing in any spectra in which the mid frequency point M is adjacent to some other band. FIG. 31 and FIG. 32 show the low low (LL) and low high (LH) spectra after the lowband has again been bandsplit and each sub-band decimated by 2. In this case M2 indicates the frequency point midway between L and M. Note that M2 is either adjacent to L or to M both of which have aliasing guard regions.

Figure 20:
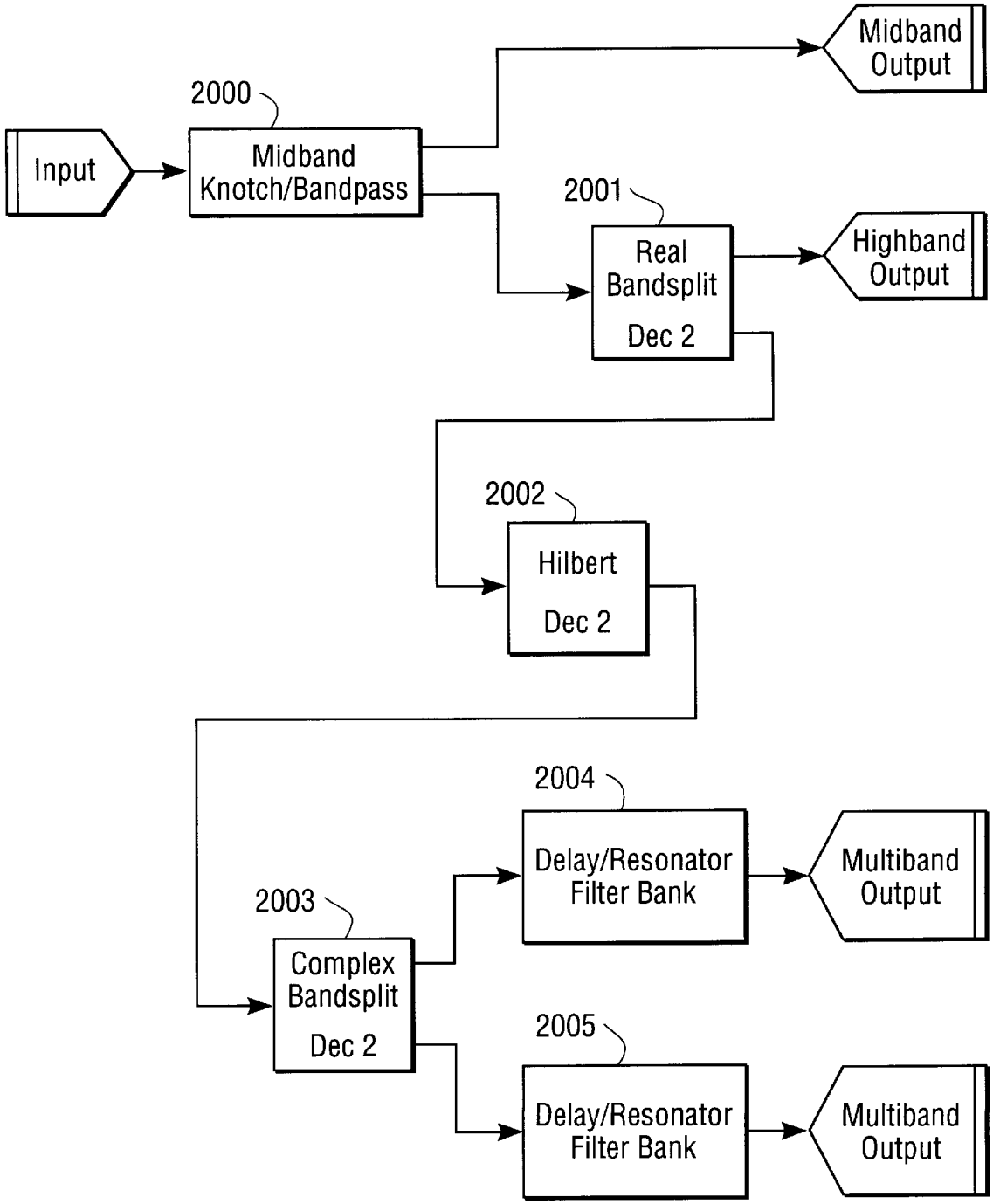
FIG. 20 is a functional representation of a second embodiment of the hybrid bandsplitter filter bank analyzer of the present invention, wherein a midband notch/bandpass filter is utilized, and wherein a real bandsplit is performed before converting to complex.

FIG. 20 shows a second embodiment of the Hybrid Bandsplitter Filter Bank Analyzer (HBIFFT). Note that the first stage after the Midband Notch/Bandpass (2000) is a real bandsplitter/decimator (2001) followed by subsequent Hilbert Transform/decimator (2002). Since the high band is not further divided by filter banks involving complex valued comb filters it does not need to be converted to complex. The issues of aliasing avoidance are similar to those for FIG. 19.

Figure 21:
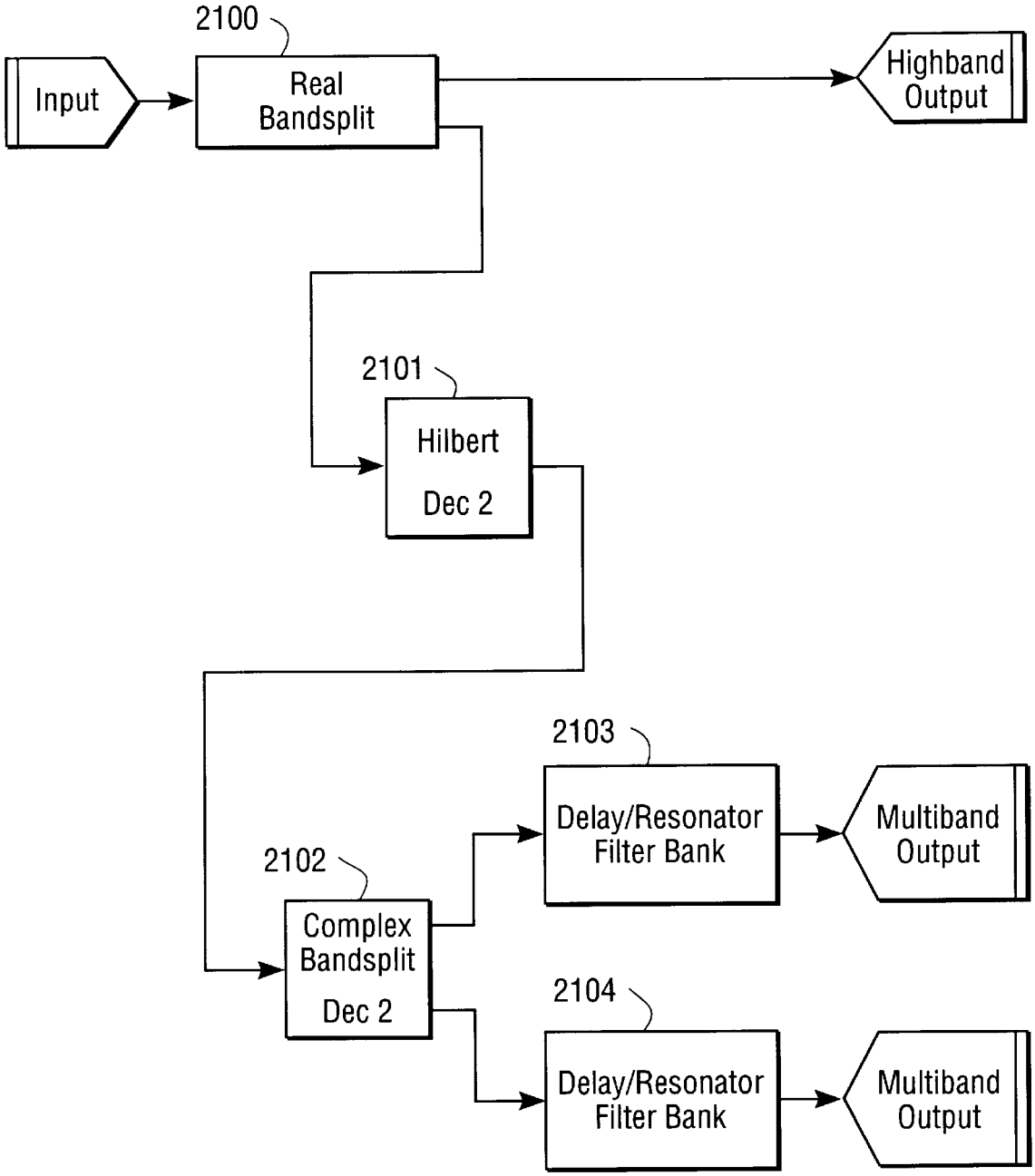
FIG. 21 is a functional representation of a third embodiment of the hybrid bandsplitter filter bank analyzer of the present invention, wherein no midband notch/bandpass filter is utilized, and wherein a real bandsplit is performed before converting to complex.

FIG. 21 shows yet a third embodiment of the Hybrid Bandsplitter Filter Bank Analyzer (HBIFFT). Note that the Midband Notch/Bandpass filter has been removed and the first real bandsplitter (2100) has no decimator associated with it so that the real low and high band outputs are undecimated. Having the first bandsplitter outputs be undecimated causes the entire system to be oversampled by a factor of two. Since each half band is undecimated half of the spectrum is zero to within aliasing error. These zero bands travel through the system and protect against aliasing so that a Midband Notch/Bandpass filter is not required.

MULTI-BAND COMPRESSOR

Figure 22:
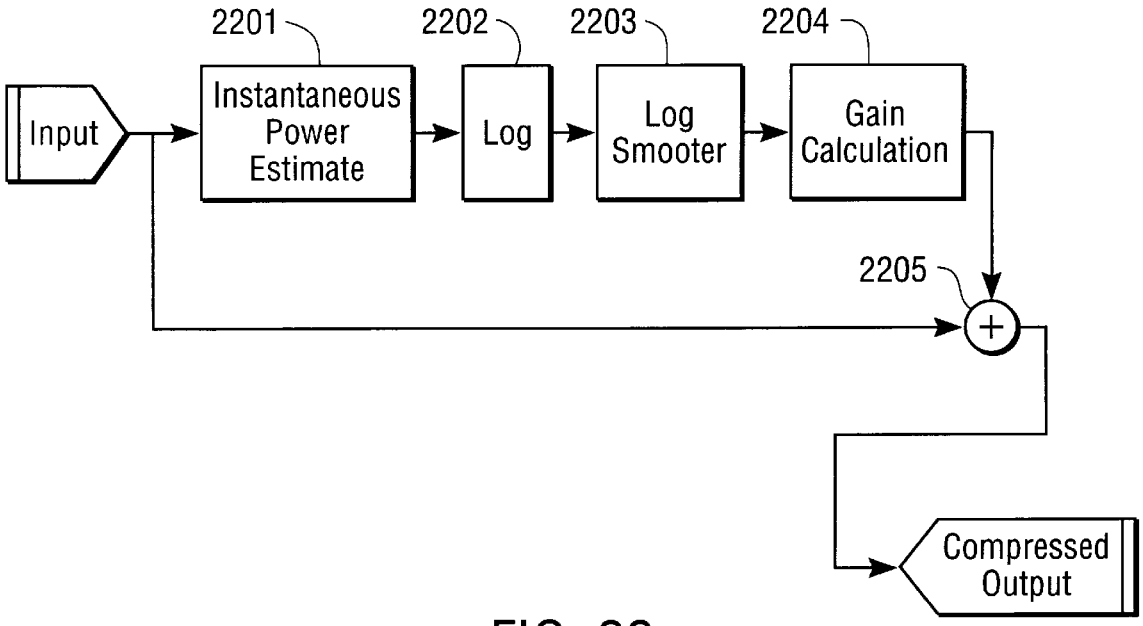
FIG. 22 is a functional representation of one of the one-band compressors of a multi-band compressor in accordance with the present invention.

FIG. 22 shows the structure of one band of the multi-band compressor. The structure is repeated for every band. An instantaneous power estimate is taken (2200), which for a real input is the square of the input value, and for a complex input is the sum of squares of the real and imaginary parts of the input. The log of the instantaneous power estimate (2201) is then taken. A crude logarithm quantized to the nearest 3 db can be taken by simply normalizing the power estimate, that is finding the number of zeros before the first 1 in the double precision power estimate. Any precision can be had by incorporating more bits to the right of the first non-zero bit in the log evaluation process. Extreme precision is not required in this process since the power estimate will be smoothed over time. The most straightforward way to accomplish this smoothing would be to apply a lowpass filter to the linear power estimate before the logarithm is taken. However, since the instantaneous power estimate is double precision due to the squaring operations, the linear smoother would involve double precision multiplications which are costly. To avoid this the smoothing is done after the logarithm is taken.

Figure 23:
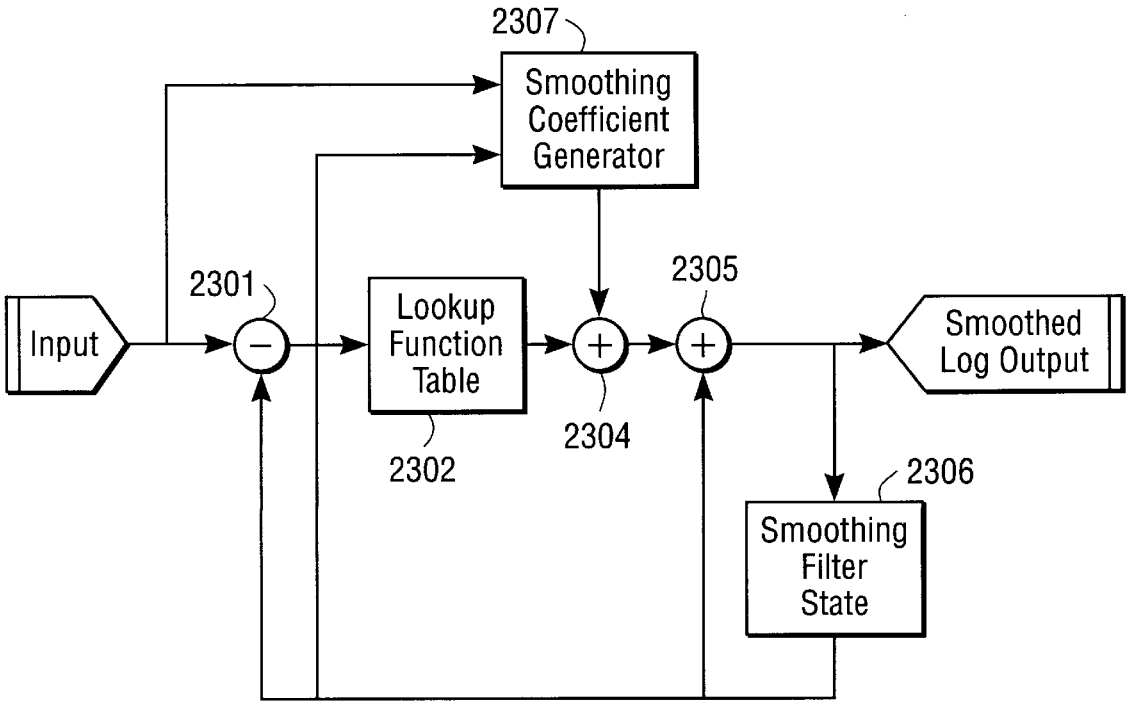
FIG. 23 is a more detailed functional diagram of the log smoother 2203 shown in FIG. 22.
Figure 24:
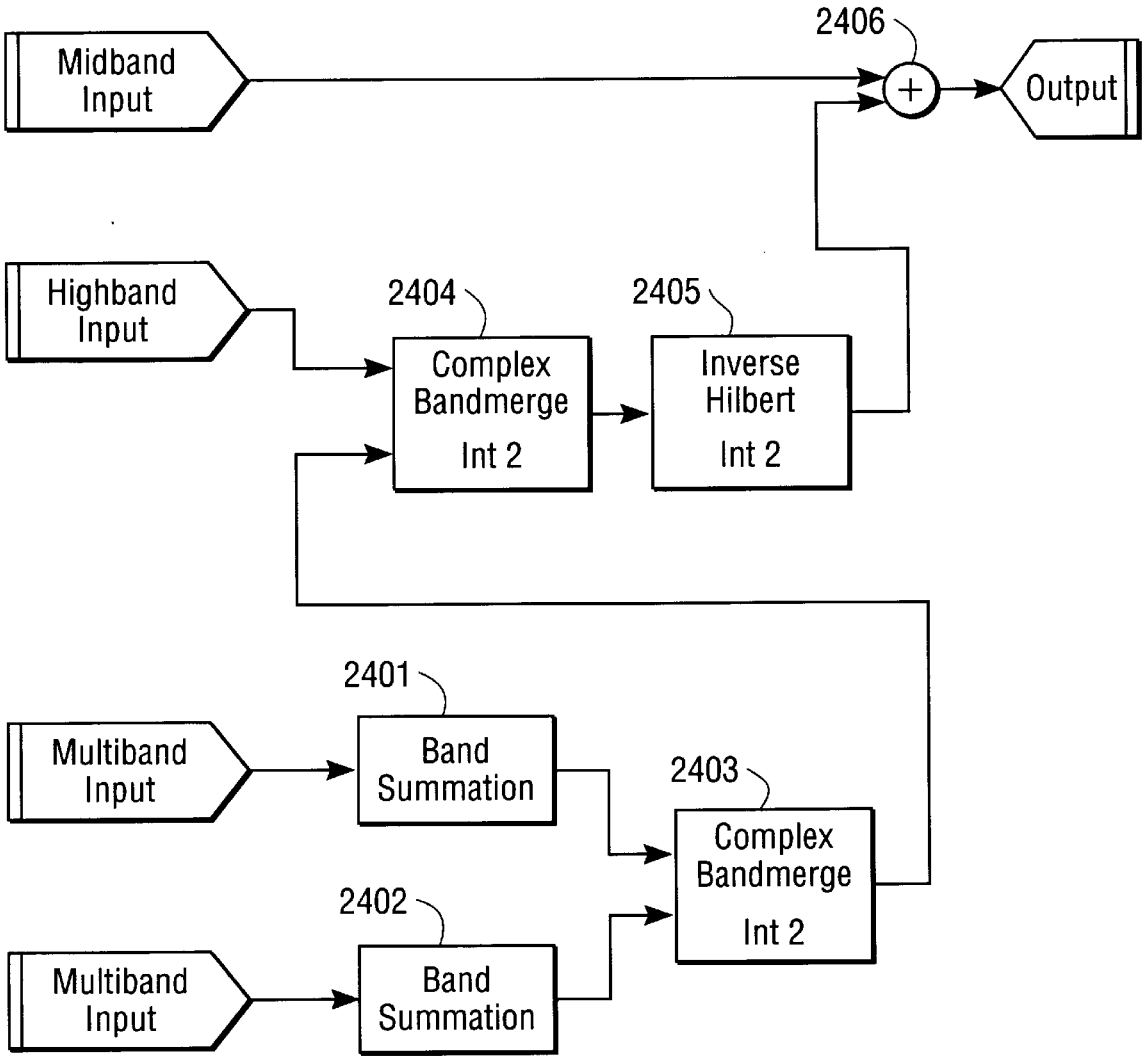
FIG. 24 is a functional representation of a hybrid bandsplitter filter bank synthesizer/combiner corresponding to the analyzer shown in FIG. 19.
Figure 25:
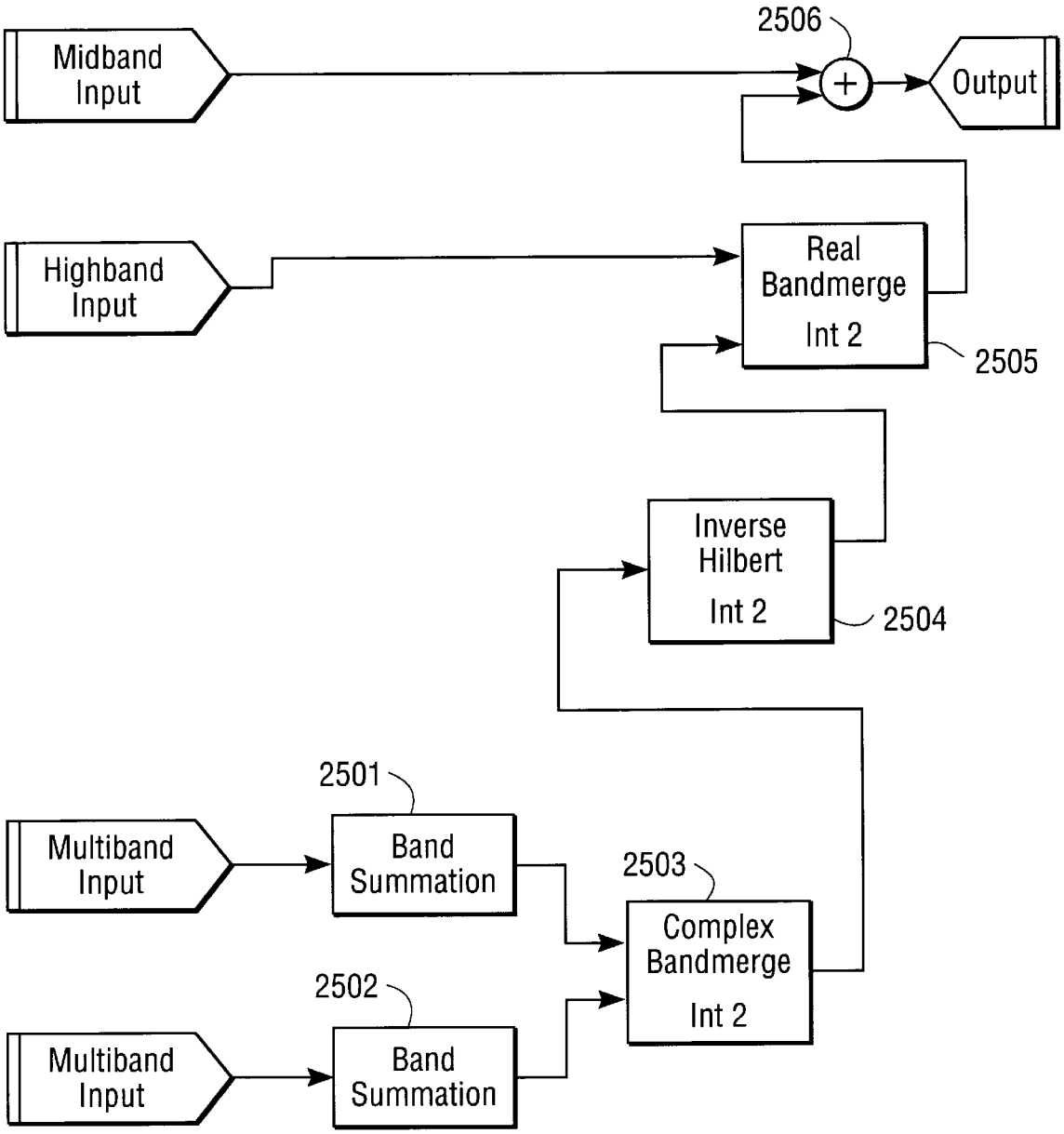
FIG. 25 is a functional representation of a hybrid bandsplitter filter bank synthesizer/combiner corresponding to the analyzer shown in FIG. 20.

A general equation which can implement the equivalent of taking the log of the output of a 1 pole recursive linear filter whose input is a linear instantaneous power estimate is:

$$S(n)=f([L(n)-S(n-1)],C)+S(n-1) \quad (3)$$

where:

S(n)=smoothed log power for sample time n;

L(n)=unsmoothed instantaneous log input power;

C=time constant; and $f(x,y)$=an arbitrary function of 2 inputs;

where $f(x,y)$ is implemented as either a table lookup function or an analytic function of two inputs. While (3) is able to generate the equivalent of log(smooth(linear power)), a close approximation can be attained through:

$$S(n)\approx f(L(n)-S(n-1))\cdot C+S(n-1)=\tilde{S}(n) \quad (4)$$

where $\tilde{S}(n)$ is a close approximation to S(n). FIG. 23 shows the structure of the Log Smoother which implements (4). The difference (2301) of the new instantaneous log estimate and the current filter state (2306) is fed to a function generator (2302) which in this case is implemented as a lookup table, the output of which is then multiplied (2304) by the smoothing coefficient time constant (2307) and added (2305) to the current filter state (2306) to produce the new smoothed log output which is written back to 2306 as the new filter state.

The Smoothing Coefficient Generator (2307) determines the time constant of the compressor. Recall that it is generally desirable to have separate attack and release time constants. The Smoothing Coefficient Generator (2307) accomplishes this by comparing the incoming instantaneous power estimate with the current filter state and selecting the appropriate coefficient for attack or release based on this comparison. In addition, it is often desirable to scale the smoothing coefficient depending on the power of the input signal. This is particularly true when very fine frequency band noise reduction algorithms are implemented. In this case it is desirable to have a longer smoothing time constant for low power signals than for high power signals. The Smoothing Coefficient Generator (2307) also accomplishes this by scaling the gain coefficient as a function of the input power estimate.

In compression algorithms, it is desirable to smooth power estimates in frequency bands over time. In the related noise reduction patents cited above, this smoothing is critical. In such a case, not only the power estimates, but the cross spectra between the left and right ear signals are also smoothed. This smoothing is accomplished by using a lowpass filter, implemented either as a linear filter or as a logarithmic smoother as described above. If the time constant associated with this lowpass filter is too long, then the signal sounds reverberated. On the other hand, if the time constant is too short, then there is insufficient smoothing and the signal sounds choppy. This choppiness is most apparent at low input signal power levels, for example, during the silence periods in a conversation where there is an air conditioner or a computer fan in the background. A method for dealing with this problem is to adaptively determine the time constant based on input power level. For low input power, the time constant is made relatively long. For high input power, the time constant is made relatively short. This serves to prevent the reverberation artifact. The determination of adaptive smoothing time constants may be done in individual frequency bands based on power in the individual bands, or it may be done over the entire passband, with only one smoothing constant being used for all frequency bands.

INCREMENTAL FFT FILTER BANK ANALYZER AND HYBRID COMB FILTER/ RESONATOR SYNTHESIZERS/COMBINERS

Since the Incremental FFT Filter Bank Analyzer and Hybrid Comb Filter/Resonator Filter Bank Analyzer run at undecimated rates with respect to the sample rate of the input signal to the filter bank, the synthesizers/combiners for both of these analyzers are simple summers which add all the bands of the filter bank to create a single summed output. This adds nothing to the group delay of the filter bank.

HYBRID BANDSPLITTER FILTER BANK SYNTHESIZER/COMBINER

Figure 17:
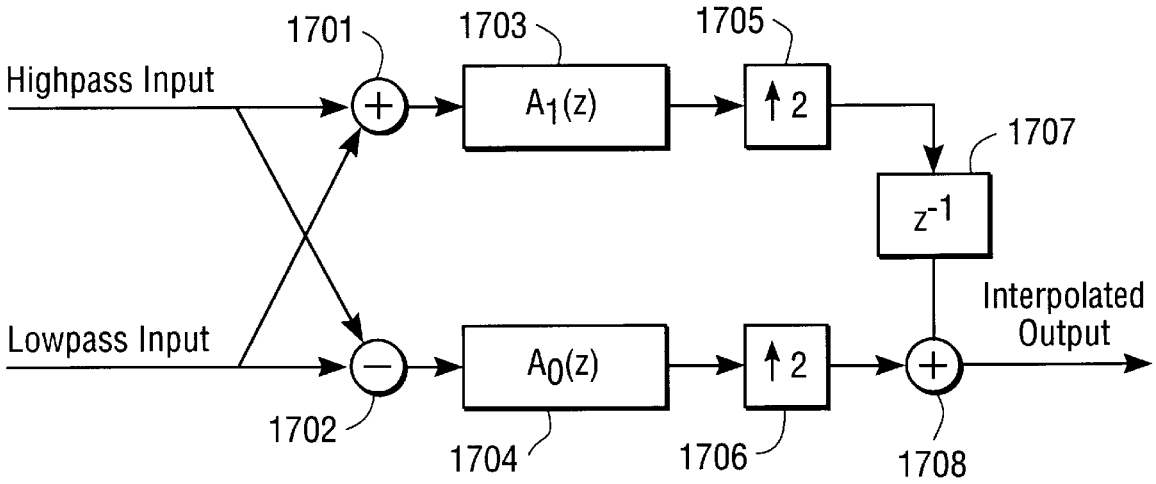
FIG. 17 is a block diagram representation of an allpass bandmerger in accordance with the present invention.

The allpass bandsplitters and Hilbert Transformers operate at decimated rates and require synthesizers/combiners to regenerate the output. The synthesizer for the allpass bandsplitter and the Hilbert Transformer is the mirror image of the corresponding analyzer graph. FIG. 17 shows the structure of the allpass bandmerger. Like the bandsplitters the interpolate by 2 operation is part of the structure. The structure is the same for real and complex synthesizers but for complex there is a separate identical path for the real and imaginary parts. The bandmerger takes two decimated by 2 inputs and produces one undecimated output. The Inverse Hilbert Transformer is similar except that only one decimated by 2 input is taken. Under ideal undecimated circumstances the Inverse Hilbert Transformer consists simply of taking the real part of the analytic signal. However, because of non-ideal filters leading to aliasing, the Inverse Hilbert Transformer helps to cancel these aliases.

Figure 26:
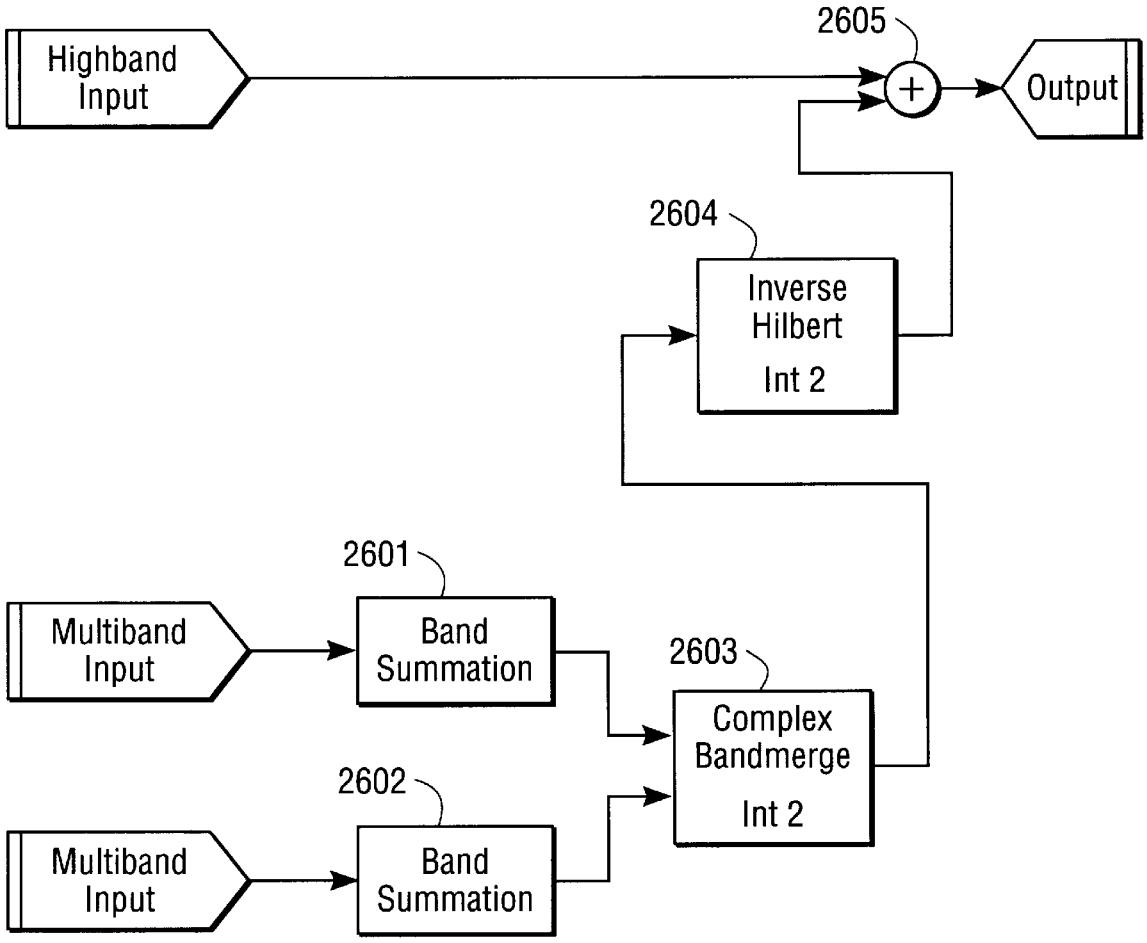
FIG. 26 is a functional representation of a hybrid bandsplitter filter bank synthesizer/combiner corresponding to the analyzer shown in FIG. 21.

Filter 24 shows the structure of the Hybrid Bandsplitter Filter Bank Synthesizer/combiner corresponding to the analyzer shown in FIG. 19. It can be seen to be the mirror system with simple summers (2401, 2402) for the high resolution filter banks in the low frequency bands. Filter 25 shows the structure of the Hybrid Bandsplitter Filter Bank Synthesizer/Combiner corresponding to the analyzer shown in FIG. 20. It is likewise a mirror system of the analyzer in FIG. 20. FIG. 26 shows the synthesizer/combiner for the oversampled by 2 case corresponding to the analyzer of FIG. 21. In this case the real band merger is a simple summer with no interpolation by 2 since the signals at this point are undecimated.

The group delay of the Hybrid Bandsplitter Filter Bank Analyzer and Synthesizer is equal to the sum of all series connected filters. The group delay of the low band filter banks has already been discussed. However, these are now running at ¼ or ⅛ of FSAMP so that the delays in real terms must be multiplied by 4 or 8. In addition the bandsplitters, bandmergers, and Hilbert Transformers and Inverse Transforms all have non constant group delay since they are nonlinear phase. This delay is greatest at the crossover bands of the bandsplitters.

PROGRAM SWITCHING

As mentioned previously, the filter banks and compression embodiments disclosed herein are implemented as digital signal processing programs on a programmable digital signal processor. The digital signal processor presents the possibility of completely changing filter bank structures and compression strategies dynamically by loading different digital signal processing programs. Other algorithm types, such as directionality based beamforming noise reduction algorithms may also be loaded. In the current state of the art, the term "programmable hearing aid" refers to a fixed hardware filter and compression structure wherein certain parameters of the fixed structure, such as the compression ratio in each band and the time constants, can be programmed. The hearing aid of the present invention brings new meaning to the term "programmable". The term "programmable" as used herein means "fully software programmable". For a fully software programmable hearing aid, the filtering algorithm is implemented entirely by a program. When a user changes rehabilitation strategies by manipulating the selector switch 112, a different software program is executed by the ALU 108. This new program may entirely change the number of bands, bandwidths, and structure of the filter bank, as well as performing additional functions such as noise suppression. As an example of the desirability of changing filter bank structures, a noise reduction system generally requires many more frequency bands than a compressor. This leads to more power consumption. When noise reduction is not needed, a simpler compression algorithm with a simpler filter bank structure should be used to reduce power consumption. The hearing aid of the present invention allows a user to easily switch from one algorithm to another.

What is claimed is:

1. A hearing aid, comprising:

an input transducer for converting audio signals into analog electrical signals;

an analog-to-digital converter for converting said analog signals into digital signals;

a processor, capable of executing digital instructions;

a memory device for storing digital data, comprising a plurality of digital signal processing means, each capable of selectively receiving said input digital signals, and each capable of generating a set of output digital signals, each of said digital signal processing means capable of processing said input digital signals to implement a selected filtering strategy designed for a selected situation, each of said digital signal processing means comprising said digital instructions, said digital instructions completely implementing each of said filtering strategies when executed by said processor, at least one of said digital signal processing means comprising:

a filter bank analyzer for dividing said input digital signals into a plurality of individual frequency band signals;

a multi-band processor for processing said plurality of individual frequency band signals to derive a plurality of processed frequency band signals comprising:

means for generating a linear instantaneous power estimate for at least one of said individual frequency band signals to produce an instantaneous linear power estimate stream;

means for converting said instantaneous linear power estimate stream into an instantaneous logarithmic power estimate stream;

means for smoothing said instantaneous logarithmic power estimate stream to produce a smoothed logarithmic power estimate stream comprising:

means for processing said instantaneous logarithmic power estimate stream with a smoothing coefficient time constant to derive a processed power estimate stream;

means for storing a current smoothing filter state;

means for processing said current smoothing filter state with said processed power estimate stream to derive a new smoothing filter state, said new smoothing filter state being stored in said storing means, and representing said smoothed logarithmic power estimate stream; and means for adaptively generating a new smoothing coefficient time constant based on a comparison of said current smoothing filter state with said instantaneous power estimate stream;

means for calculating a gain coefficient based on said smoothed logarithmic power estimate stream; and means for processing said one of said individual frequency band signals and said gain coefficient to generate one of said plurality of processed frequency band signals; and a filter bank combiner for combining said plurality of processed frequency band signals to derive said output digital signals;

wherein said filter-bank analyzer, said multi-band processor, and said filter bank combiner are digital instructions stored in said memory device and capable of being executed by said processor;

a selector manipulatable by a user for selecting one of said digital signal processing means to use in processing said input digital signals, said selector enabling the user to dynamically select which of said filtering strategies to implement in any particular situation, each of said filtering strategies optimized for a particular listening environment;

a digital-to-analog converter for converting said output digital signals into a set of output analog electrical signals; and an output transducer for converting said output analog electrical signals into a set of output audio signals.

2. A hearing aid, comprising:

an input transducer for converting audio signals into analog electrical signals;

an analog-to-digital converter for converting said analog signals into input digital signals;

a storage for storing a plurality of instruction sequences, each instruction sequence, when executed, implementing a selected digital signal processing strategy, each of said digital processing strategies being optimized for a particular listening environment, at least one of said instruction sequences comprising:

a filter bank analyzer portion for dividing said input digital signals into a plurality of individual frequency band signals;

a multi-band processor portion for processing said plurality of individual frequency band signals to derive a plurality of processed frequency band signals comprising:

means for generating a linear instantaneous power estimate for at least one of said individual frequency band signals to produce an instantaneous linear power estimate stream;

means for converting said instantaneous linear power estimate stream into an instantaneous logarithmic power estimate stream;

means for smoothing said instantaneous logarithmic power estimate stream to produce a smoothed logarithmic power estimate stream comprising:

means for processing said instantaneous logarithmic power estimate stream with a smoothing coefficient time constant to derive a processed power estimate stream;

means for storing a current smoothing filter state;

means for processing said current smoothing filter state with said processed power estimate stream to derive a new smoothing filter state, said new smoothing filter state being stored in said storing means, and representing said smoothed logarithmic power estimate stream; and means for adaptively generating a new smoothing coefficient time constant based on a comparison of said current smoothing filter state with said instantaneous power estimate stream;

means for calculating a gain coefficient based on said smoothed logarithmic power estimate stream; and means for processing said one of said individual frequency band signals and said gain coefficient to generate one of said plurality of processed frequency band signals; and a filter bank combiner portion for combining said plurality of processed frequency band signals to derive said output digital signals;

a logic unit, coupled to said digital-to-analog converter, for executing one of said instruction sequences to process said input digital signals in accordance with one of the selected digital signal processing strategies, said logic unit providing a set of output digital signals;

a program sequencer coupled to said logic unit and said storage for selectively sending one of said instruction sequences to said logic unit for execution thereby;

an instruction sequence selector, coupled to said program sequencer, manipulatable by a user for controlling said program sequencer to select one of said program sequences to send from said storage to said logic unit, said selector enabling the user to dynamically select which of said digital signal processing strategies to implement for a particular listening environment;

a digital-to-analog converter for converting said output digital signals into a set of output analog electrical signals; and an output transducer for converting said output analog electrical signals into a set of output audio signals.

3. A hearing aid, comprising:

an input transducer for converting audio signals into analog electrical signals;

an analog-to-digital converter for converting said analog signals into input digital signals;

a memory device for storing digital instructions representing a plurality of filtering strategies, including:

a filter bank analyzer for dividing said input digital signals into a plurality of individual frequency band signals, said analyzer comprising:

a first section of complementary comb filters for processing said input digital signals to provide a plurality of intermediate frequency band signals; and a final section of complementary comb filters for processing said intermediate frequency band signals to provide said plurality of individual frequency band signals;

a multi-band processor for processing said plurality of individual frequency band signals to derive a plurality of processed frequency band signals comprising:

means for generating a linear instantaneous power estimate for at least one of said individual frequency band signals to produce an instantaneous linear power estimate stream;

means for converting said instantaneous linear power estimate stream into an instantaneous logarithmic power estimate stream;

means for smoothing said instantaneous logarithmic power estimate stream to produce a smoothed logarithmic power estimate stream comprising:

means for processing said instantaneous logarithmic power estimate stream with a smoothing coefficient time constant to derive a processed power estimate stream;

means for storing a current smoothing filter state;

means for processing said current smoothing filter state with said processed power estimate stream to derive a new smoothing filter state, said new smoothing filter state being stored in said storing means, and representing said smoothed logarithmic power estimate stream; and means for adaptively generating a new smoothing coefficient time constant based on a comparison of said current smoothing filter state with said instantaneous power estimate stream;

means for calculating a gain coefficient based on said smoothed logarithmic power estimate stream; and means for processing said one of said individual frequency band signals and said gain coefficient to generate one of said plurality of processed frequency band signals; and a filter bank combiner for combining said plurality of processed frequency band signals to derive said output digital signals;

wherein said filter bank analyzer includes said digital instructions, said digital instructions completely implementing each of said filtering strategies when executed by said processor;

a selector, coupled to said memory device and capable of being manipulated by a user for dynamically selecting one of said filtering strategies;

a digital-to-analog converter for converting said output digital signals into a set of output analog electrical signals; and an output transducer for converting said output analog electrical signals into a set of output audio signals.

4. A hearing aid, comprising:

an input transducer for converting audio signals into analog electrical signals;

an analog-to-digital converter for converting said analog signals into input digital signals;

a memory device for storing digital instructions representing a plurality of filtering strategies, including:

a filter bank analyzer for dividing said input digital signals into a plurality of individual frequency band signals, said analyzer comprising:

a section of complementary comb filters for processing said input digital signals to provide a plurality of intermediate frequency band signals; and a section of recursive filter resonators for processing said intermediate frequency band signals to provide said plurality of individual frequency band signals;

a multi-band processor for processing said plurality of individual frequency band signals to derive a plurality of processed frequency band signals comprising:

means for generating a linear instantaneous power estimate for at least one of said individual frequency band signals to produce an instantaneous linear power estimate stream;

means for converting said instantaneous linear power estimate stream into an instantaneous logarithmic power estimate stream;

means for smoothing said instantaneous logarithmic power estimate stream to produce a smoothed logarithmic power estimate stream;

means for calculating a gain coefficient based on said smoothed logarithmic power estimate stream; and means for processing said one of said individual frequency band signals and said gain coefficient to generate one of said plurality of processed frequency band signals; and a filter bank combiner for combining said plurality of processed frequency band signals to derive a set of output digital signals;

wherein said filter bank analyzer, said multi-band processor, and said filter bank combiner each include said digital instructions, said digital instructions completely implementing each of said filtering strategies when executed by said processor;

selecting means, coupled to said memory device and capable of being manipulated by a user for dynamically selecting one of said filtering strategies;

a digital-to-analog converter for converting said output digital signals into a set of output analog electrical signals; and an output transducer for converting said output analog electrical signals into a set of output audio signals.

5. A hearing aid, comprising:

an input transducer for converting audio signals into analog electrical signals;

an analog-to-digital converter for converting said analog signals into input digital signals;

means for generating a linear instantaneous power estimate for at least a portion of said input digital signals to produce an instantaneous linear power estimate stream;

a memory device for storing digital instructions representing a plurality of filtering strategies, including:

means for converting said instantaneous linear power estimate stream into an instantaneous logarithmic power estimate stream;

means for smoothing said instantaneous logarithmic power estimate stream to produce a smoothed logarithmic power estimate stream comprising:

means for processing said instantaneous logarithmic power estimate stream with at smoothing coefficient time constant to derive a processed power estimate stream;

means for storing a current smoothing filter state;

means for processing said current smoothing filter state with said processed power estimate stream to derive a new smoothing filter state, said new smoothing filter state being stored in said storing means, and representing said smoothed logarithmic power estimate stream; and means for adaptively generating a new smoothing coefficient time constant based on a comparison of said current smoothing filter state with said instantaneous power estimate stream; and means for receiving and processing said smoothed logarithmic power estimate stream and said input digital signals to derive a set of output digital signals;

wherein said means for converting, said means for smoothing, and said means for receiving each include said digital instructions, said digital instructions completely implementing each of said filtering strategies when executed by said processor;

selecting means, coupled to said memory device and capable of being manipulated by a user for dynamically selecting one of said filtering strategies;

a digital-to-analog converter for converting said output digital signals into a set of output analog electrical signals; and an output transducer for converting said output analog electrical signals into a set of output audio signals.

* * * * *